US010737874B2

(12) United States Patent
Pourian et al.

(10) Patent No.: US 10,737,874 B2
(45) Date of Patent: Aug. 11, 2020

(54) MULTI-PIECE DISPENSER FOR USE WITH A CONSUMABLE PRODUCT

(71) Applicant: WM. WRIGLEY JR. COMPANY, Chicago, IL (US)

(72) Inventors: Neema Pourian, Skokie, IL (US); Shashi Mishra, Bangalore (IN); Atanu Palit, Bangalore (IN); Vinod Vibhute, Bangalore (IN); Vijender Singh, Bangalore (IN); David R. Phillips, Downers Grove, IL (US); Noah Pentelovitch, New York, NY (US)

(73) Assignee: WM. WRIGLEY JR. COMPANY, Chicago, IL (US)

( * ) Notice: Subject to any disclaimer, the term of this patent is extended or adjusted under 35 U.S.C. 154(b) by 85 days.

(21) Appl. No.: 15/380,501

(22) Filed: Dec. 15, 2016

(65) Prior Publication Data

US 2017/0096286 A1 Apr. 6, 2017

Related U.S. Application Data

(62) Division of application No. 13/635,839, filed as application No. PCT/US2011/029367 on Mar. 22, 2011, now abandoned.

(60) Provisional application No. 61/424,391, filed on Dec. 17, 2010, provisional application No. 61/316,052, filed on Mar. 22, 2010.

(51) Int. Cl.

| | |
|---|---|
| ***B65D 83/04*** | (2006.01) |
| ***B65D 1/02*** | (2006.01) |
| ***B65D 25/22*** | (2006.01) |
| ***B65D 75/36*** | (2006.01) |
| ***B65D 75/52*** | (2006.01) |
| ***B65D 85/60*** | (2006.01) |
| ***B65B 1/02*** | (2006.01) |

(52) U.S. Cl.

CPC ..... *B65D 83/0472* (2013.01); *B65B 1/02* (2013.01); *B65D 25/22* (2013.01); *B65D 75/36* (2013.01); *B65D 75/527* (2013.01); *B65D 83/04* (2013.01); *B65D 83/0463* (2013.01); *B65D 85/60* (2013.01); *B65D 2583/0445* (2013.01)

(58) Field of Classification Search

CPC ... B65D 1/00; B65D 1/14; B65D 1/22; B65D 1/24; B65D 83/08; B65D 83/0835; B65D 83/0805

See application file for complete search history.

(56) References Cited

U.S. PATENT DOCUMENTS 2,484,892 A * 10/1949 Keston ..... B65D 25/106 206/37
2,820,631 A * 1/1958 Santos ..... B65H 35/0026 493/354
3,386,619 A * 6/1968 Douglas ..... B65D 83/00 118/506
3,410,450 A * 11/1968 Fortenberry ..... A61J 7/0076 221/7

(Continued)

*Primary Examiner* — Andrea L Wellington
*Assistant Examiner* — Richard D Crosby, Jr.

(57) ABSTRACT

A multi-piece dispenser for confectionary products including a housing defining an inner chamber for storing a multi-piece package of confectionary product including a slot for receiving an end portion of the multi-piece package for dispensing the confectionary product and a retention member for retaining the end portion of the package within the slot for further dispensing.

19 Claims, 20 Drawing Sheets

(56) References Cited

U.S. PATENT DOCUMENTS 3,549,006 A * 12/1970 Meierhoefer ..... B65D 75/42 206/820
4,180,160 A * 12/1979 Ogawa ..... A47K 10/3818 206/210
4,881,675 A * 11/1989 Varley, III ..... A47K 10/38 225/43
4,882,175 A * 11/1989 Ream ..... A21C 3/06 426/5
4,967,929 A * 11/1990 Turner ..... B65C 9/1892 156/750
5,133,980 A * 7/1992 Ream ..... B65H 35/002 206/409
5,134,957 A * 8/1992 Nobili ..... A45D 40/0087 118/235
5,358,140 A * 10/1994 Pellegrino ..... A61F 15/001 206/440
5,494,204 A * 2/1996 Wang ..... A47F 13/00 206/394
5,579,669 A * 12/1996 Kind ..... A23G 3/563 242/588.6
5,634,570 A * 6/1997 Casper ..... B65H 35/0026 206/395
5,755,356 A * 5/1998 Bastiaens ..... B42D 5/005 221/33
5,851,347 A * 12/1998 Rodriguez ..... B65C 11/0278 156/576
5,851,348 A * 12/1998 Muenzer ..... B65C 11/004 156/577
5,921,433 A * 7/1999 Friar ..... B65D 83/0472 221/25
6,027,068 A * 2/2000 Lantsman ..... B23K 3/063 226/187
6,213,343 B1 * 4/2001 Damikolas ..... A61F 15/002 221/25
6,227,274 B1 * 5/2001 Koyama ..... B65H 37/007 118/257
6,364,188 B1 * 4/2002 Dunshee ..... B65H 35/0026 206/407
6,386,416 B1 * 5/2002 Dunshee ..... B65H 35/0026 225/43
6,425,888 B1 * 7/2002 Embleton ..... A61F 9/0008 604/290
6,453,968 B1 * 9/2002 Hsu ..... B65H 35/0033 118/257
6,464,077 B1 * 10/2002 Liu ..... B65D 85/04 206/388
6,786,447 B2 * 9/2004 Geib ..... A47K 10/3818 215/235
6,837,395 B2 * 1/2005 Windorski ..... B42D 5/005 221/1
D506,290 S * 6/2005 Longoni ..... D28/66
6,913,178 B2 * 7/2005 Huang ..... B65H 35/0026 225/24
D510,387 S * 10/2005 Lynn ..... D19/65
6,962,266 B2 * 11/2005 Morgan ..... A47L 15/4472 221/25
7,121,499 B2 * 10/2006 Lammers ..... B26F 3/02 242/588.6
7,559,436 B2 * 7/2009 Bieger ..... G07F 11/44 221/256
7,563,468 B2 * 7/2009 Bougoulas ..... B65D 83/0472 206/233
7,568,580 B2 * 8/2009 Fenton ..... A61F 5/08 206/390
D618,906 S * 7/2010 Covington ..... D19/67
8,002,113 B1 * 8/2011 Cummings ..... B65D 85/672 206/408
8,020,802 B2 * 9/2011 Iacona ..... B65D 85/04 242/153
D671,596 S * 11/2012 Ruthe-Steinsiek ..... D19/69
8,499,965 B2 * 8/2013 Sheffield ..... B65H 35/002 221/127
8,602,280 B2 * 12/2013 Chang ..... B26F 3/02 225/43
9,199,819 B2 * 12/2015 Chandaria ..... B65H 35/0026
10,531,678 B2 * 1/2020 Wilson ..... B65B 11/48
2003/0094475 A1 * 5/2003 Coleman ..... B65H 49/08 225/46
2004/0124305 A1 * 7/2004 Huang ..... B65H 35/0026 242/588.6
2004/0149798 A1 * 8/2004 Hoffman ..... B65H 35/0026 225/46
2005/0177275 A1 * 8/2005 Harvey ..... G06F 19/00 700/244
2006/0251780 A1 * 11/2006 Sainz ..... B65D 43/161 426/394
2009/0151115 A1 * 6/2009 Klein ..... B65D 77/044 16/221
2013/0126548 A1 * 5/2013 Pourian ..... B65D 83/0472 221/70
2015/0225158 A1 * 8/2015 Lyzenga ..... B65D 75/527 206/476
2016/0021915 A1 * 1/2016 Baxter ..... A47J 47/02 426/295
2017/0096286 A1 * 4/2017 Pourian ..... B65D 83/0472

* cited by examiner

MULTI-PIECE DISPENSER FOR USE WITH A CONSUMABLE PRODUCT

CROSS-REFERENCE TO RELATED APPLICATIONS

The present divisional application claims priority to U.S. application Ser. No. 13/635,839, filed Feb. 11, 2013, which is a 371 of International Application No. PCT/US2011/29367, filed Mar. 22, 2011, which claims benefit from U.S. Application No. 61/316,052 filed Mar. 22, 2010 and U.S. Application No. 61/424,391 filed Dec. 17, 2010, the contents of which are fully incorporated herein by reference in their entirety.

TECHNICAL FIELD

The disclosure relates to a dispenser for use with a consumable product, such as a confectionery product. More specifically, the disclosure is directed to a dispenser for use with a multi-piece package of confectionary product, in particular, chewing gum.

BACKGROUND OF THE INVENTION

Packaging for consumable products, in particular, confectionary products, such as for example chewing gum, come in all sizes, shapes, and containers depending on the needs and desires of the consumer. Moreover, the marketing of the product has a great influence on the overall design and appearance of the package. Even though the enjoyment of a confectionary product, i.e., chewing gum, is an individual experience, it is often shared with others, such as for example, by offering others a piece of gum or candy.

Chewing gum is often carried by an individual in discrete packages having a limited number of pieces. Although the individual packages are convenient for transporting and storage, the limited piece count and individual packages make it difficult to share in a space where a number of individuals are present. Accordingly, it would be desirable to have a dispenser that allows individuals the ability to obtain pieces of chewing gum or other confections for enjoyment, and to be able to share with others. Moreover, consumers want flexibility in their packaging which can meet the needs of various occasions depending on the situation.

Alternatively, in many retail locations where chewing gum is sold, it is often desirable for a consumer to have the ability to purchase a single or select number of confectionary pieces, instead of purchasing an entire pack. Moreover, many retail locations have limitations on space and do not have the ability to stock large quantities of confections. Therefore, it would be desirable to have the ability to easily sell to consumers a select number of confectionary pieces, depending on the quantity requested by the consumer.

Even though it is desirable to have a dispenser that allows for sharing among a number of individuals or providing individual pieces that may be purchased by different consumers, it is critical to ensure that the gum pieces are protected from outside environmental factors. Accordingly, it is desirable to have individual pieces that are sealed, as to preserve the quality and flavor of the confection, while at the same time protecting it from the outside environment.

In order to provide a more sustainable dispenser, it is further desirable to consider alternatives for packaging and dispensing of consumable products. The ability to refill an outer container or dispenser enables either a retail location or an individual consumer to minimize the amount of waste that is associated with consuming the products. In addition, the cost associated with only purchasing refills instead of having to purchase more costly outer containers is further benefit.

SUMMARY OF THE INVENTION

The disclosure further includes a multi-piece dispenser for confectionary products including a housing defining an inner chamber for storing a multi-piece package of confectionary product. The housing including a slot for receiving one end portion of the multi-piece package for dispensing the confectionary product. The dispenser further includes a tension assembly disposed in the inner chamber of the housing for securing another end portion of the multi-piece package within the inner chamber and retaining the other end portion of the package within the slot for further dispensing.

Moreover, the disclosure further includes a multi-piece package containing a plurality of gum pieces, wherein the gum pieces are enclosed within a material and sealed along three sides. Alternatively, the gum pieces may be sealed individually within blister-type packages that are interconnected with one another to form a continuous coil or strip. The package allows for unique dispensing and integration within an outer housing for dispensing of confectionary products.

BRIEF DESCRIPTION OF THE DRAWINGS

The present invention will now be described by way of example, with reference to the accompanying drawings.

DETAILED DESCRIPTION OF THE INVENTION

Figure 1:
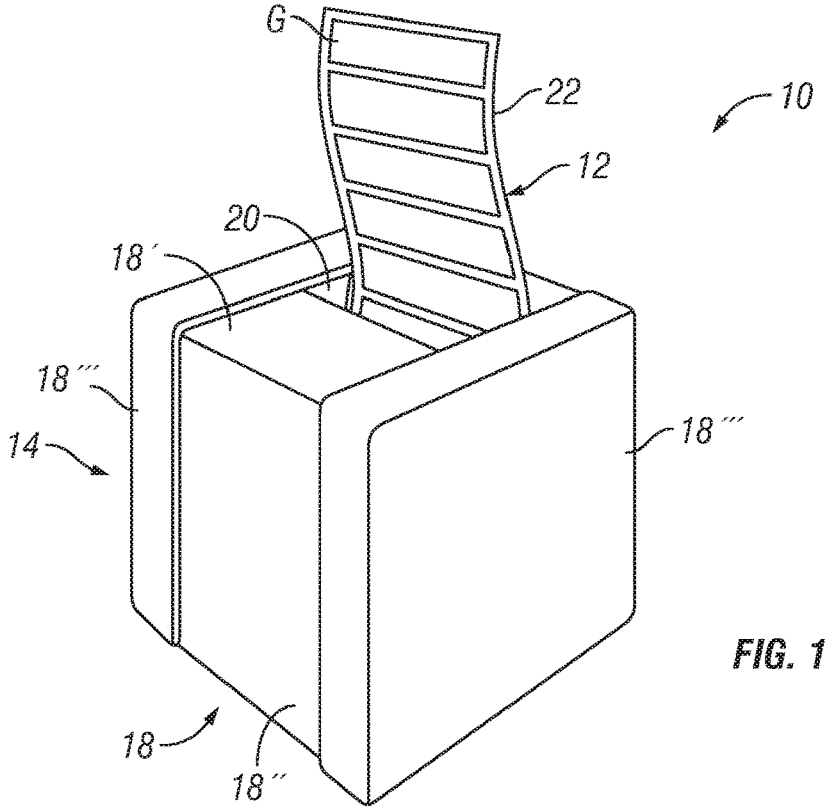
FIG. 1 is a perspective view of a dispenser including a multi-piece package in accordance with one embodiment of the invention.

The present disclosure provides a multi-piece dispenser for consumable products, such as for example, confectionary products. In one aspect, the multi-piece dispenser may be used for dispensing chewing gum. The disclosure further provides alternate embodiments of a dispenser and a multi-piece package, as well as a method for manufacturing the multi-piece package.

The dispenser 10, in accordance with one aspect of the present invention, includes a housing 14 containing a multi-piece package 12 of confectionary product, such as for example chewing gum G. The term "multi-piece package" is herein used to mean a strip-like structure having a plurality of individual pieces of gum, wherein each individual piece of gum is sealed within a material (e.g., film, blister package) and coupled together to form the strip-like structure (i.e., a bandoleer). The multi-piece package may have a predefined width and length. The individual pieces may further be divided by a tear line, such that upon the exertion of force, the individual pieces may be separated from one another. The multi-piece package may be provided in a roll-like configuration or an accordion style configuration, such as discussed in further detail below. Alternate configurations may also be used for packaging and dispensing depending on the type of confectionary being used, such as for example, alternate configurations and sizing may be used depending on if tab, stick or pellet chewing gum is being packaged and sold for use with the dispenser. Moreover, the multi-piece package may include a variety of individual gum pieces in a number of different piece counts, such as for example, 25, 30, 60, 90 or any number of pieces as desired by the consumer.

Alternatively, the confectionary pieces may be oriented in various configurations relative to one another. As shown, the confectionary pieces may be oriented in a long side/edge orientation. In another embodiment, the confectionary pieces may be configured within the package such that the short side/edge is leading (i.e., the individual pieces are positioned end to end) within the bandoleer.

Although the Figures and related disclosure are directed to packaging and dispensing of confectionary products, in particular chewing gum, the present invention may be directed to various applications, including but not limited to other consumable products, alternate confectionary products such as mints, candy (including hard, chewy or gummy candy), chocolate and/or any other confectionary. Moreover, alternate configurations of the dispenser, such as, for example, those discussed below, may be utilized including but not limited to, cube shaped, rectangular shaped, triangular shaped, bean shaped, circular shaped, clam shell shaped, cone shaped, or any other shape suitable for use as a dispenser, or combinations thereof. In addition, various combinations of dispensers may be coupled together, such that a dual (double) or triple dispenser may be provided. Accordingly, the Figures are exemplary and illustrate various aspects of the present disclosure.

In one embodiment, the dispenser of the present invention may be designed to be a refillable dispenser. This allows for the consumer to maximize the use of the dispenser and to not increase the waste associated with discarding the entire dispenser. In another embodiment, the dispenser may not be refillable. In the event that the dispenser is not refillable, the consumer would discard the dispenser upon using the entire contents of the multi-piece package.

In accordance with one aspect of the invention, the dispenser has a housing defining an inner chamber for storing the multi-piece package of confectionary product. The housing may further include a plurality of wall members, as shown in the provided Figures. In one embodiment, the wall members forming the housing may be integrally formed together as one unitary piece or part. Alternatively, in another embodiment the wall members may be separately manufactured and then hingedly couple to one another and/or fit together upon assembly (i.e., such as a lid or other type configuration). Alternatively, in another embodiment, various manufacturing and assembly methods may be used for the assembly of the walls to form the housing. Accordingly, the housing of the present disclosure may be configured in alternate ways depending on the materials used for assembly of the dispenser. Moreover, the wall members may further include structural elements, including for example, but not limited to elements (i.e., ribs) to enhance or increase strength and/or decrease thickness of the wall members.

In general, the dispenser may be formed of various materials, including for example but not limited to, plastic or plastic-like material, molded pulp, paperboard, cardboard, any other paper based compositions, metal or metal alloys, composites, any other alternate suitable materials, or combinations thereof as recognized by one of skill in the art. The plastic or plastic-like material may be selected from those materials that may be injection moldable, including for example, but not limited to polypropylene and/or polyethylene.

Figure 2:
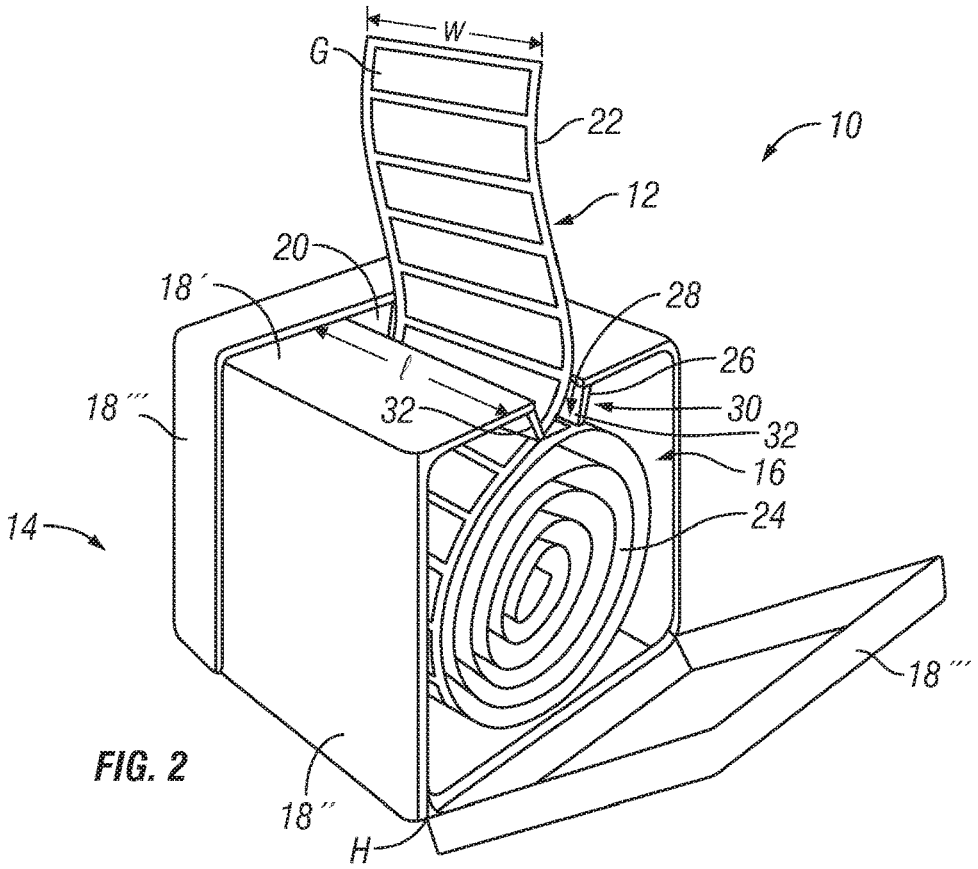
FIG. 2 is an alternate view of the dispenser and multi-piece package as shown in FIG. 1.

In accordance with one embodiment, as shown in FIGS. 1-5, the dispenser 10 includes a housing 14 that is generally cube-shaped having a plurality of wall members 18 defining an inner chamber 16. As previously suggested, the wall members 18 may be integrally formed as a unitary piece. As shown in FIG. 1, the housing 14 further includes a top wall member 18', a bottom wall member (not shown) and side walls members 18" integrally formed as one unitary piece. Additional, wall members 18''' are provided to form the entire housing 14 upon assembly. The wall members 18''' may be separately manufactured components, such as for example, end caps (as shown in FIG. 1). In another embodiment, at least one wall members 18''' may be integrally formed with the other wall members 18' and 18". Moreover, in another embodiment, at least one wall member 18''' may be hingedly attached, H, along one side to the housing 14, such as illustrated in FIG. 2, therein providing access to inner chamber 16. In another embodiment, alternate wall members may be hingedly attached, depending on the design of the housing 14. The hingedly attached wall members may be coupled through the use of a mechanical hinge or living hinge, either molded out of plastic or through the use of other mechanical type components. Moreover, in another embodiment (not shown), the housing 14 may be folded out of paperboard, such that all of the wall members are integrally connected to one another as required to achieve a foldable cube-like configuration. As a result, the folded paperboard edges may act as a hinge-like member. In accordance with one embodiment, the layout for the housing 14 may be punch stamped from a paperboard material, and then assembled, thereby forming the dispenser.

Upon the assembly of the dispenser, a slot 20 may be defined by the housing 14 therein allowing an end portion 22 of the multi-piece package 12 to be disposed outside of the housing 14 for access by a consumer. "End portion" is herein used to mean the end of the multi-piece package that remains accessible to the consumer when the multi-piece package is configured for packaging, such as for example, in a rolled or accordion type configuration. The length (l) of the slot 20 is shaped to reflect the general width (w) of the multi-piece package 12, such that the package may be readily provided through slot 20. In general, the slot 20 is configured to receive the end portion 22 of the multi-piece package 12 for continued consumer use. As the consumer removes individual pieces from the end portion 22 of the package 12, the package 12 may be pulled and a remaining portion 24 of the package 12 is advanced through the slot 20. The remaining portion 24 of the package 12 remains disposed in the inner chamber 16 of the housing, as can be seen in FIG. 2. The size and shape of the slot 20 may be altered or specifically dimensioned depending on the design of the multi-piece package 12, such as for example, for different forms of gum, i.e., stick, tab, pellet, any other alternate forms, configurations of the confectionary pieces (e.g., side to side or end to end) or other combinations thereof.

The slot 20 may further define an opening 26 that defines an access portion 28 for inserting package 12 into the slot 20. As a result, the dispenser and corresponding package is non-threading. "Non-threading" is herein used to mean that the package is inserted directly into the slot through a side opening and as a result does not have to be inserted through the entire length (l) of the slot from the inner chamber. As a result the end portion 22 of package 12 is easily positioned within slot 20 for continued use.

Figure 3:
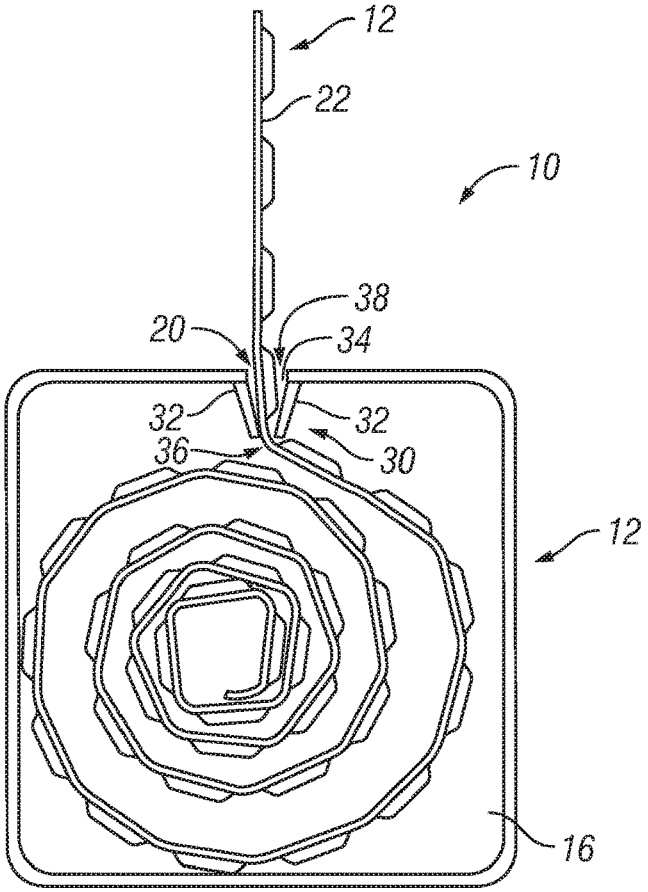
FIG. 3 is a side cross-sectional view of the dispenser and multi-piece package as shown in FIG. 1.
Figure 4:
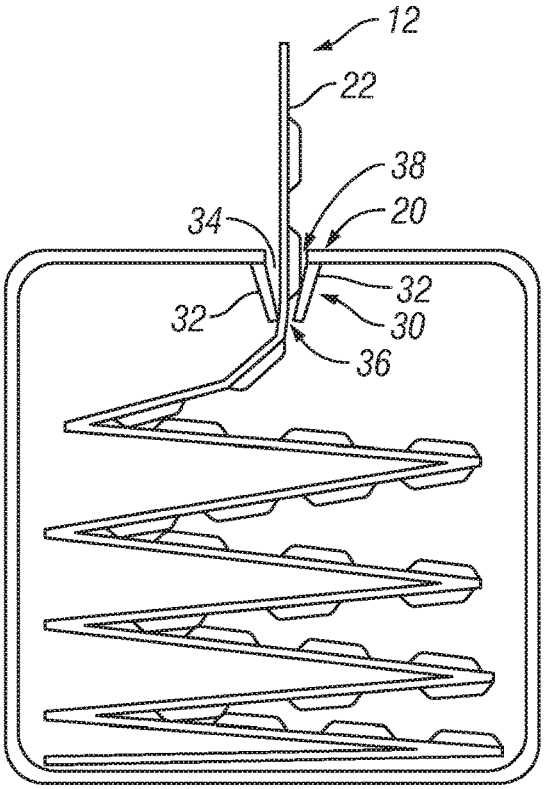
FIG. 4 is a side cross-sectional view of the dispenser and multi-piece package in accordance with another embodiment.

A retention member 30 may be further disposed within housing 14 for retaining the multi-piece package within the slot 20 for continued dispensing and/or access. In accordance with one embodiment, the retention member 30 is integrally formed within the housing 14. Moreover, in one embodiment, the retention member 30 includes at least one retention tab 32 for retaining a portion of the multi-piece package 12. In another embodiment, the retention member 30 includes two retention tabs 32 for retaining a portion of the multi-piece package. In one aspect, the retention tab(s) 32 may be coupled to the interior surface of the housing along the length (l) of the slot 20. In an embodiment, the retention tab(s) 32 may be integrally formed as part of the slot 20. The retention tab(s) 32 may be provided at a predefined angle relative to the slot and/or housing, such that multi-piece package is retained within the slot and does not fall back into the inner chamber 16 of the housing 14. As further illustrated in FIGS. 3 and 4, the retention tab(s) 32 in combination with the slot 20 therein define an access channel 34. The access channel 34 may further be defined through the angling of the retention tabs 32, therein providing a narrower inlet portion 36 compared to the outlet portion 38 defining slot 20 on the external surface of the housing. The narrow inlet portion 36 ensures that the multi-piece package does not re-enter the inner chamber of the dispenser and is retained in position relative to the slot 20. Alternate embodiments of the retention tabs and related orientations to one another may be used depending on the size of the multi-piece package and the overall dimensions of the slot 20. Moreover, the retention tabs may be angled at varying degrees and used individually or in combination with one another to retain the multi-piece package 12. Different orientations of retention member 30, in particular retention tab(s) 32, to slot 20 may be used depending on the configuration of the multi-piece package 12, such as illustrated in FIGS. 3 and 4 (i.e., a roll assembly or an accordion assembly). Alternatively, the retention tab(s) may be formed as part of the outer dispenser to properly align the multi-piece package within the dispenser. The size and angling of the retention tab(s) may be altered depending on the type, size and shape of the confectionary provided in the multi-piece package. As discussed in more detail below, at least one of the retention tabs may be made of a material that provides a relative amount of"flex" such that one or more retention tabs may move slightly upon pressure being applied by the package.

Figure 5:
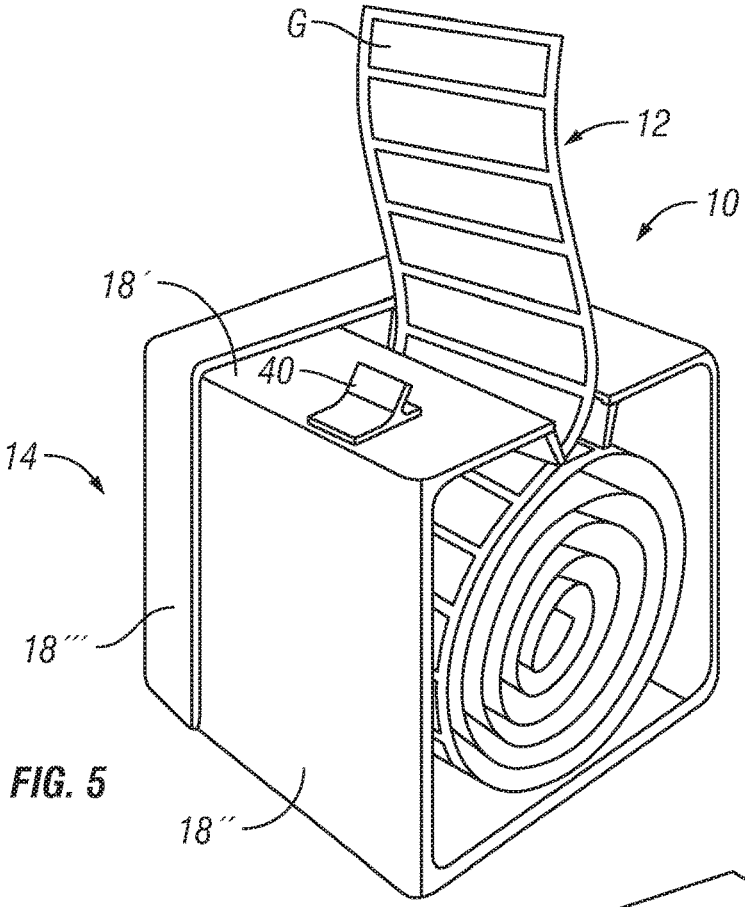
FIG. 5 is a perspective partial view of a dispenser and a multi-piece package in accordance with another embodiment.

Upon the dispensing of the gum pieces G, the individual gum pieces may be separated (i.e., torn) from the remaining multi-piece package 12, so that the gum pieces may be used by the consumer and the remaining portion of the multi-piece package 12 is retained by the dispenser 10. As shown in FIG. 5, in an alternate embodiment, a tear member 40 may further be provided in connection with housing 14 to assist in separating the gum pieces along a tear line provided between each of the individual compartments containing at least one gum piece G. The tear member 40 may be integrally formed with the housing. The tear member 40 may be disposed on the housing, such as for example, on wall member 18', as shown in FIG. 5. Alternate locations and relative positions of tear member 40 may be further provided depending on the design of the dispenser. The tear member may further be configured to have different sizes, shapes or orientations depending on the design of the dispenser and the multi-piece package. Although not shown, the tear member may further be included on any embodiment of the dispenser considered.

As previously, suggested, alternate embodiments of the dispenser may be used. Accordingly, the above-mentioned components of dispenser 10 made be used either individually or in combination with alternate embodiments of the dispenser. As previously suggested, alternate configurations of package 12 may be used, such as foil wrapped packaging or blister-type packaging, for use in connection with tab, stick, pellet, sphere, or alternate gum form pieces.

Figure 6:
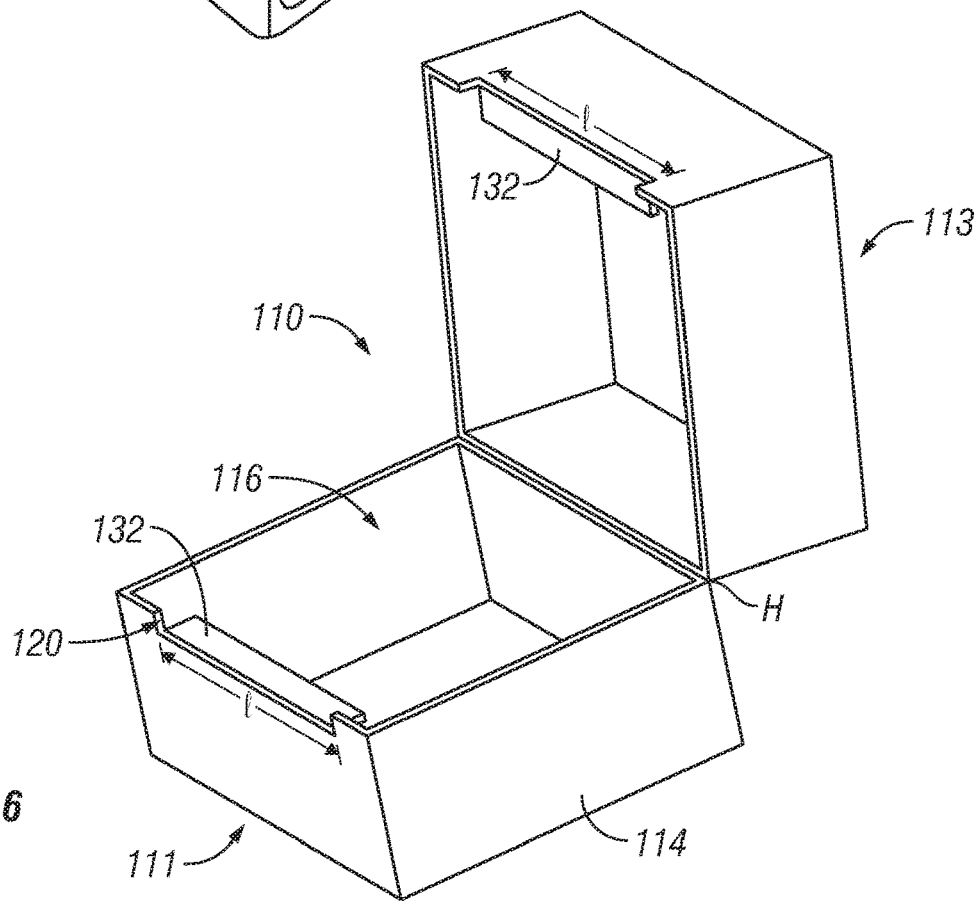
FIG. 6 is a perspective view of a dispenser in accordance with another embodiment.

Alternate embodiments of the dispenser may further include a housing comprised of a plurality of portions that are coupled together and further define an inner chamber. In one embodiment, the dispenser may include a cube or cube-like dispenser 110, as shown in FIG. 6, that includes a portion 111 and a portion 113 that a hingedly H coupled together to form housing 114 defining inner chamber 116. Upon closing portion 111 and portion 113, slot 120 may be defined for receiving the end portion of the multi-piece package. The slot 120 is non-threading. Retention tab(s) 132 may further be disposed along the length (l) of the slot. In one embodiment, the retention tab(s) 132 are each integrally formed each portion 111 and 113, respectively. When portion 111 and portion 113 are joined to form dispenser 110, a retention member 130 is formed through the combination of retention tabs 132.

Alternate embodiments of the present invention further include a dispenser having a triangular or pyramidal shape, as well as other shapes/configurations, as further illustrated by dispensers 210, and 310 in FIGS. 7-11.

Figure 7:
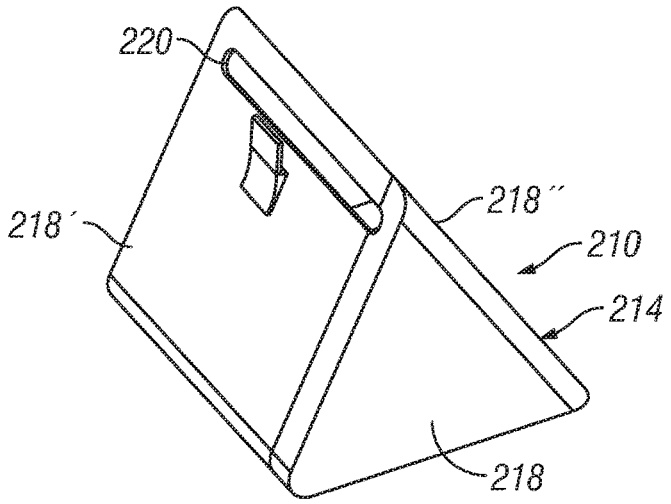
FIG. 7 is a perspective view of a dispenser in accordance with another embodiment of the invention.
Figure 8:
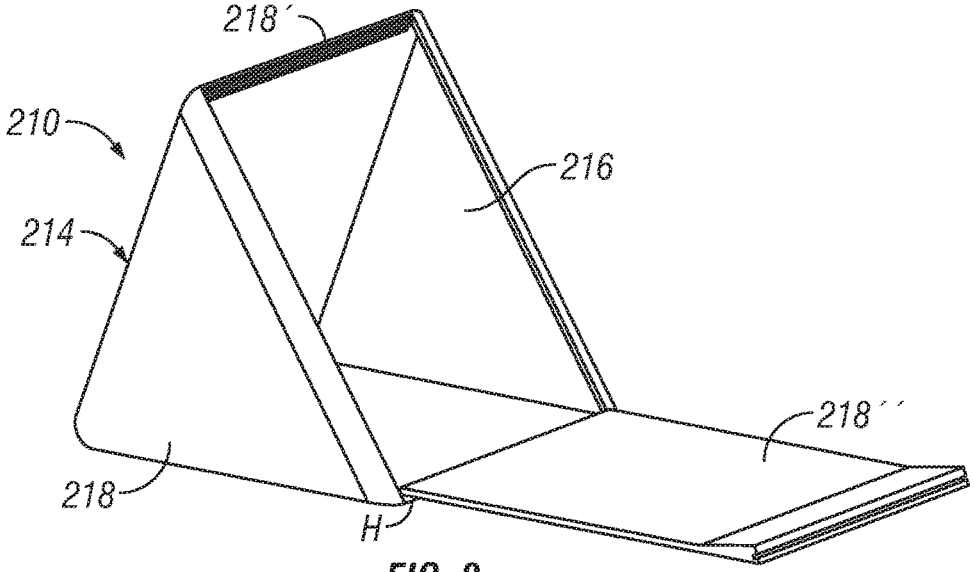
FIG. 8 is a back perspective view of an alternate embodiment of a dispenser, wherein the back wall portion is hingedly attached.
Figure 9:
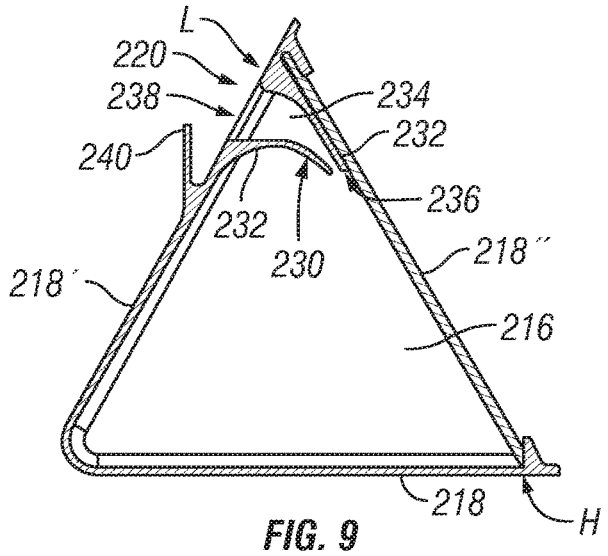
FIG. 9 is a side cross-sectional view of an alternate embodiment of a dispenser.

The triangular or pyramid shaped dispenser 210 may be used in combination with the multi-piece package 12 previously discussed. In accordance with one embodiment, as shown in FIGS. 7-10, dispenser 210 includes a housing 214 defining an inner chamber 216 for storing the multi-piece package of confectionary products, i.e., chewing gum. A plurality of wall members 218 may be used in combination to form the housing 214. The wall members 218 may be integrally formed as one unitary piece or separately manufactured for assembly. For example, as shown in FIG. 7, wall 218 may be a separate end cap or hingedly coupled to form the housing 214. Alternatively, as shown in FIG. 8, back wall 218" may be hingedly coupled to form housing 214. More specifically, as shown in FIG. 9, dispenser 210 may further include a hinge (H) wherein wall member 218" may be hingedly attached or coupled to wall member 218. Accordingly, wall member 218" may be de-coupled (i.e., separated) from wall member 218' along line (L), therein providing access to inner chamber 216. Each of these configurations allow for the consumer to readily access inner chamber 216 for placement of the package (not shown) within the dispenser.

Figure 10:
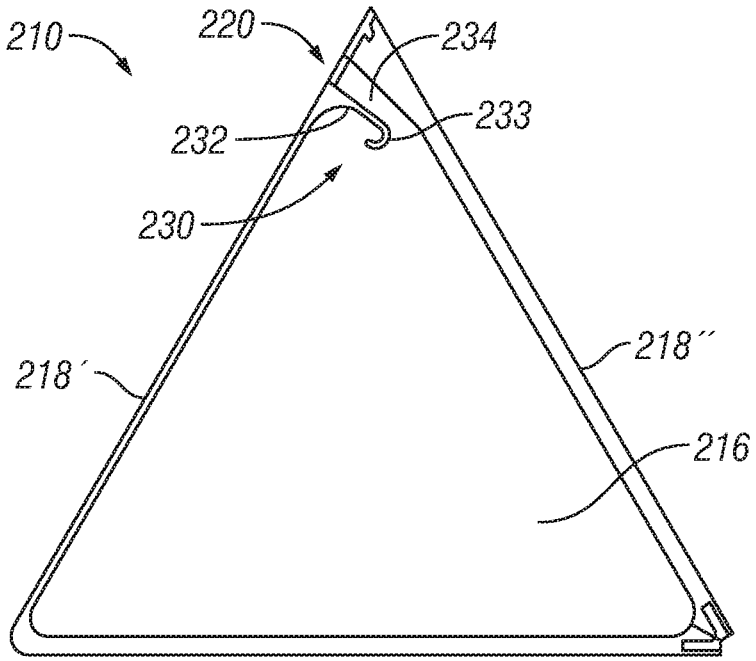
FIG. 10 is a side cross-sectional view of a dispenser in accordance with another embodiment of the invention.

Depending on the design of the dispenser, different walls may be separated or hingedly coupled to allow access to the inner chamber 216. A slot 220 is further provided for receiving the end portion of the multi-piece package of confectionary. A tear member 240 may further be provided in connection with housing 214. As seen in more detail in FIGS. 9 and 10, alternate embodiments of retention member 230 may be provided, for retaining the multi-piece package in position. As shown in FIG. 9, the retention member may further include separate retention tabs 232 defining an access channel 234 having an inlet portion 236 and an outlet portion 238. Alternatively, one retention tab 232 may be provided in connection with a wall portion 218" to form access channel 234, as shown in FIG. 10. The use of one retention tab minimizes the additional components that are required and utilizes an interior portion of a wall member to further retain the package within the dispenser. As previously discussed, the retention tabs are designed to retain the package within the access channel 234 leading to slot 220, such that the package does not fall back within inner chamber 216.

Depending on the design of the dispenser, the retention tabs may further include at least one slight curvature to facilitate the relative movement of the package into the access channel 234. As further shown in FIG. 10, retention tab 232 may have further include a curved portion 233 that allows the package to readily glide around the end of retention tab 232, such that the package or confectionary pieces do not get caught on the end of the retention tab.

Figure 11:
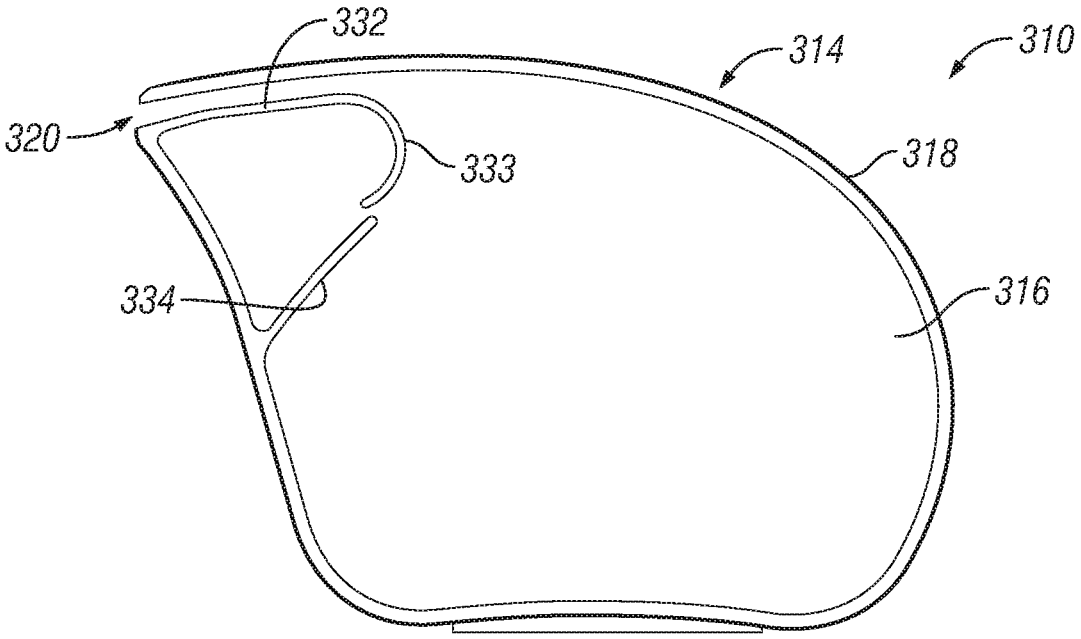
FIG. 11 is a side cross-sectional view of a dispenser in accordance with another embodiment of the invention.
Figure 12:
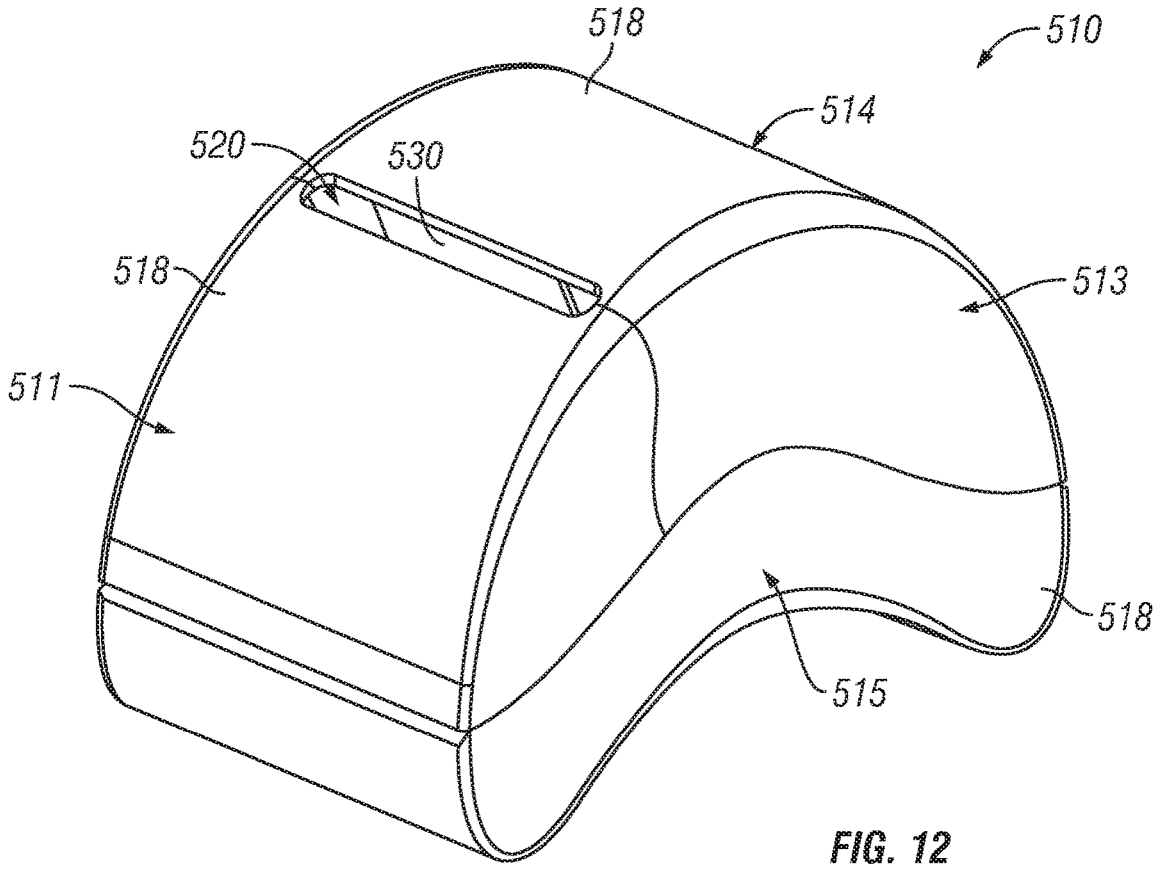
FIG. 12 is a perspective view of a dispenser in accordance with another embodiment of the invention.
Figure 13:
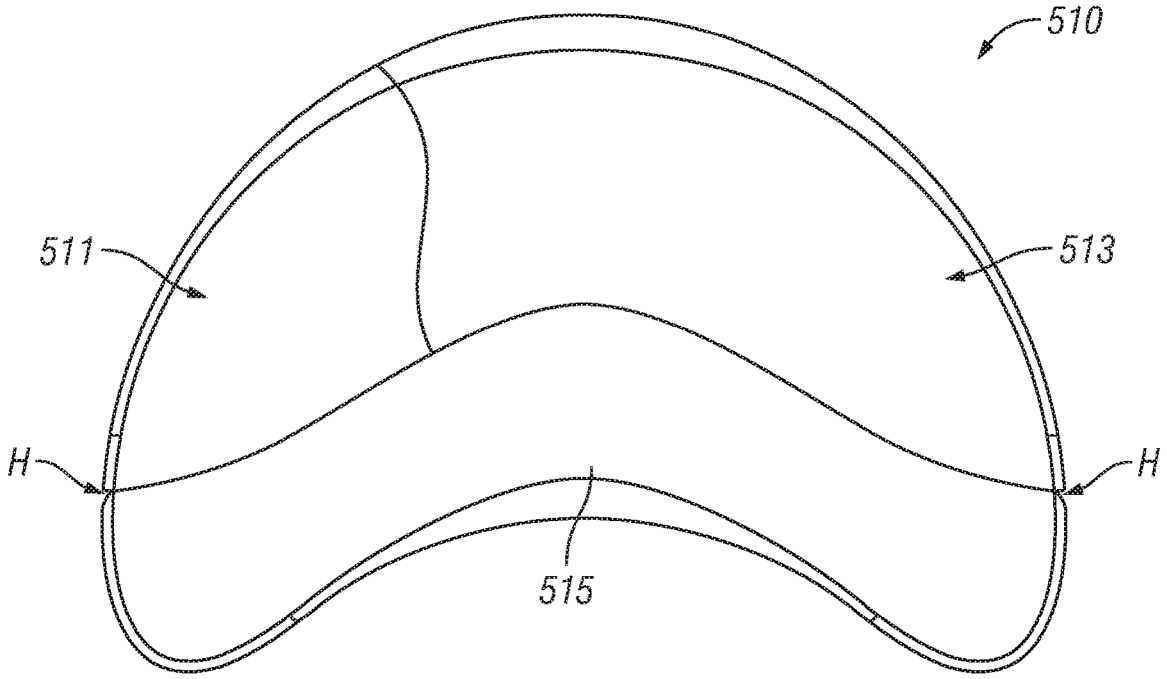
FIG. 13 a side view of the dispenser as shown in FIG. 12.

An alternate embodiment of the dispenser 310 is shown in FIG. 11, wherein a modified circular or tear-drop shaped outer dispenser is provided. The dispenser 310 includes housing 314 defined by at least one outer wall 318, and side walls (not shown). At least one side wall (not shown) may be removed to allow access by the consumer to the inner chamber 316. As previously discussed, a single retention tab 332 may be provided in combination with the inner surface of the outer wall 318 to form retention member 330. The retention tab 332 further includes a curved portion 333 that facilitates the movement of the package (not shown) within the dispenser 310 and through slot 320. An additional guide member 334 may be integrated within the inner chamber 316 of the housing 314. The guide member 334 is provided to prevent the package from becoming caught on retention member 332 within curved portion 333. Guide member 334 may be designed in different lengths, forms or configuration to facilitate the movement of the package within the dispenser.

Additional embodiments of the dispenser may further include alternate slot configurations. Such alternate slot configurations provided additional access to the multi-piece package by the consumer or provided alternate methods for tearing the individual pieces from the multi-piece package.

Figure 14:
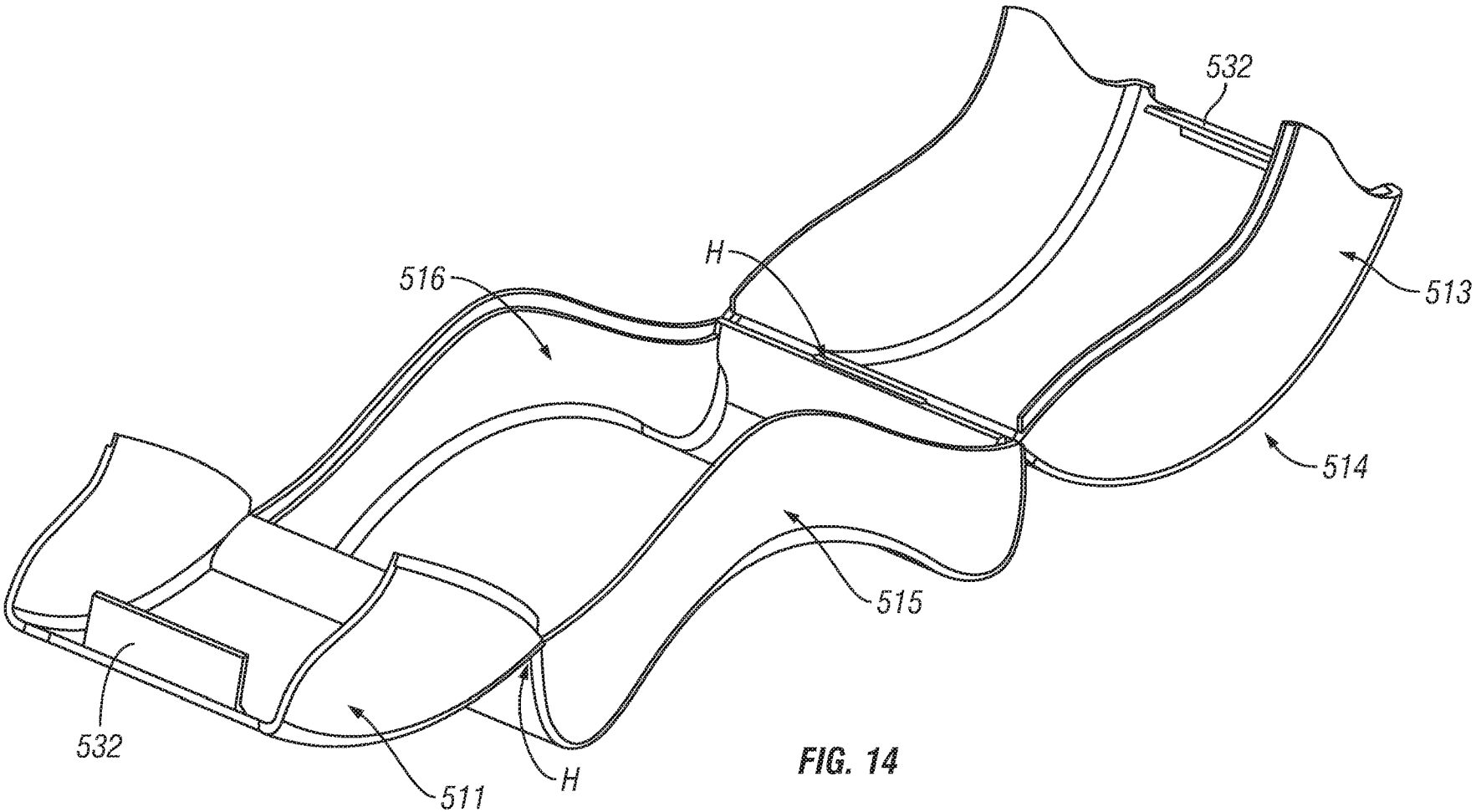
FIG. 14 is a perspective view of the dispenser as shown in FIG. 12 in an opened position.
Figure 15:
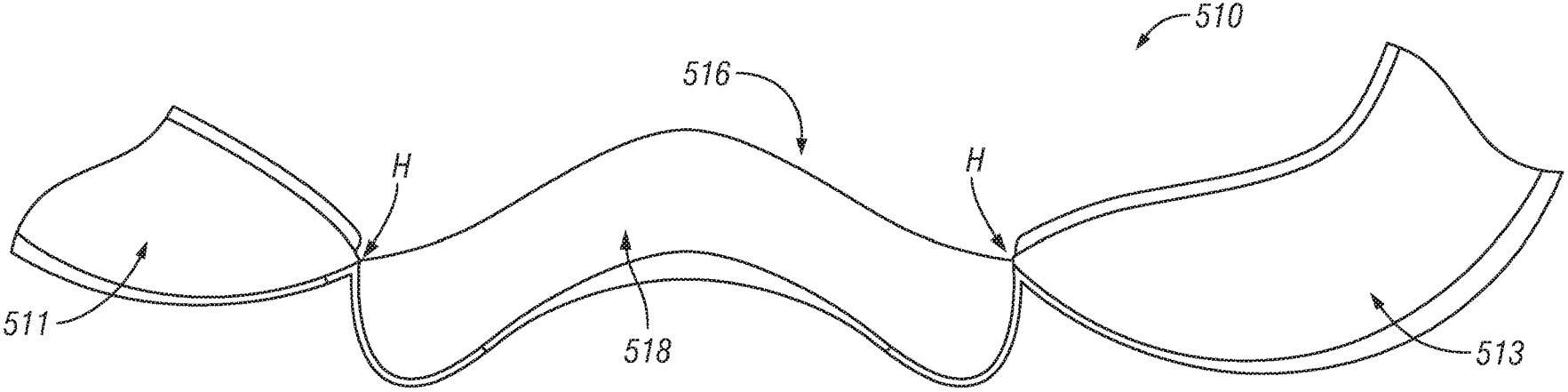
FIG. 15 a side view of the dispenser as shown in FIG. 14.

Another embodiment of the present invention may include a dispenser 510 having a multi-piece configuration (such as, for example, the bean shaped configuration), wherein the pieces are hingedly connected to one another, as further illustrated in FIGS. 12-15. As an example, the bean shaped dispenser 510 may be used in combination with the multi-piece package 12 as previously discussed. Accordingly, dispenser 510 includes a housing 514 defining an inner chamber 516 (as shown in FIGS. 14 and 15) for storing the multi-piece package of confectionary products, i.e., chewing gum. A plurality of wall members 518 may be used in combination to form the housing 514. The wall members 518 may be integrally formed as one unitary piece or separately manufactured for assembly. More particularly, in one embodiment, dispenser 510 may further include a side portion 511, a side portion 513, and a base portion 515. Portions 511 and 513 may be hingedly attached (H) to base portion 515. The base portion 515 is stationary, whereas portions 511 and 513 move relative to the base portion thereby providing access to the inner chamber, as illustrated in FIGS. 14 and 15. A slot 520 is further provided for receiving the end portion of the multi-piece package of confectionary. A retention member 530 may be provided, as partially shown in FIG. 12 within slot 520, for retaining the multi-piece package in position. The retention member may further include retention tabs 532, as further illustrated in FIG. 14. Although not illustrated, a tear member may further be provided in connection with the bean shaped dispenser.

Figure 16:
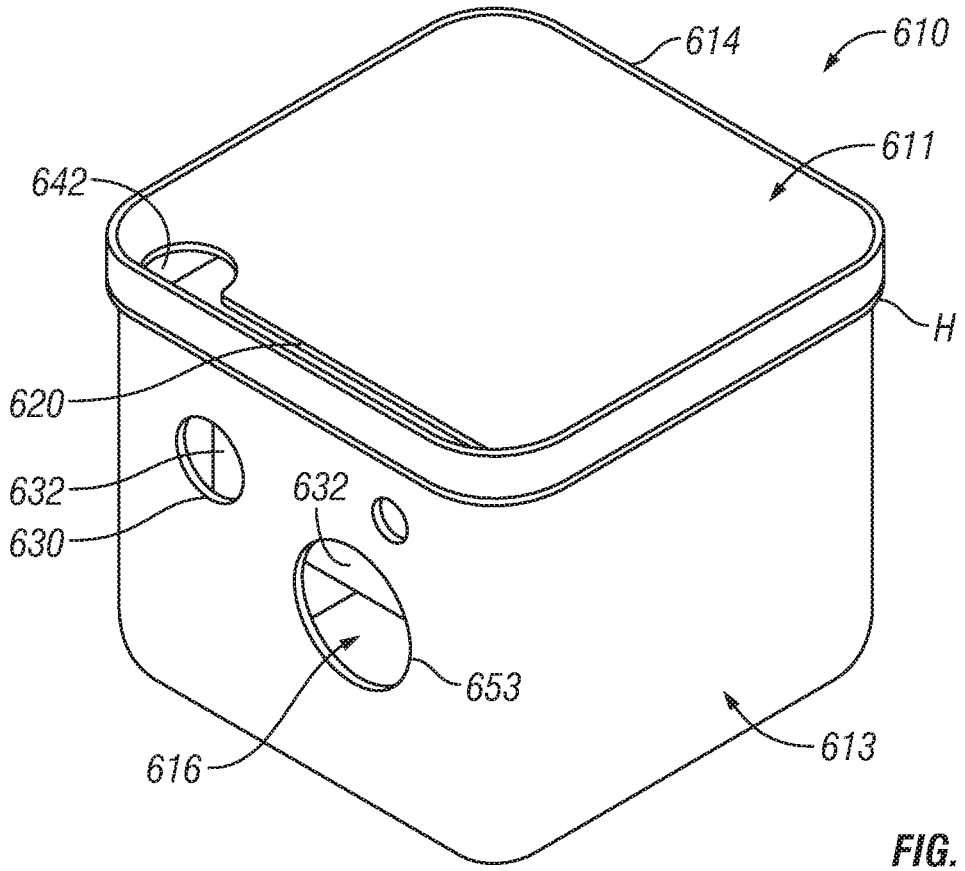
FIG. 16 is a perspective view of a dispenser in accordance with another embodiment of the invention.

In another embodiment, dispenser 610 may further be provided in a cube-like configuration, as illustrated in FIG. 16. The dispenser 610 includes a housing 614 defining an inner chamber 616. The housing 614 further includes a top portion 611 and a bottom portion 613. The top portion 611 may be hingedly attached to bottom portion 613, or alternatively may be a separate portion that is detachably coupled. The top portion 611 further defines a slot 620 for receiving and retaining the multi-piece package. Alternate openings may be integrated within the dispenser or slot opening (e.g., for a finger to place through) for further assisting the consumer in accessing the end portion of a multi-piece package. For example, the slot 620 may further include a contact opening 642 for further assisting the consumer in accessing the end portion of a multi-piece package. At least one retention tab 632 may be further included to assist in retaining the multi-piece package. The retainer tab 632 (although not wholly visible) may be integrally formed with top portion 611. Openings 650 may further be provided by bottom portion 613. Openings 650 may be used for display purposes, such as displaying a design provided on the multi-piece package, or to allow the customer to access the multi-piece package through the openings 650.

Figure 17:
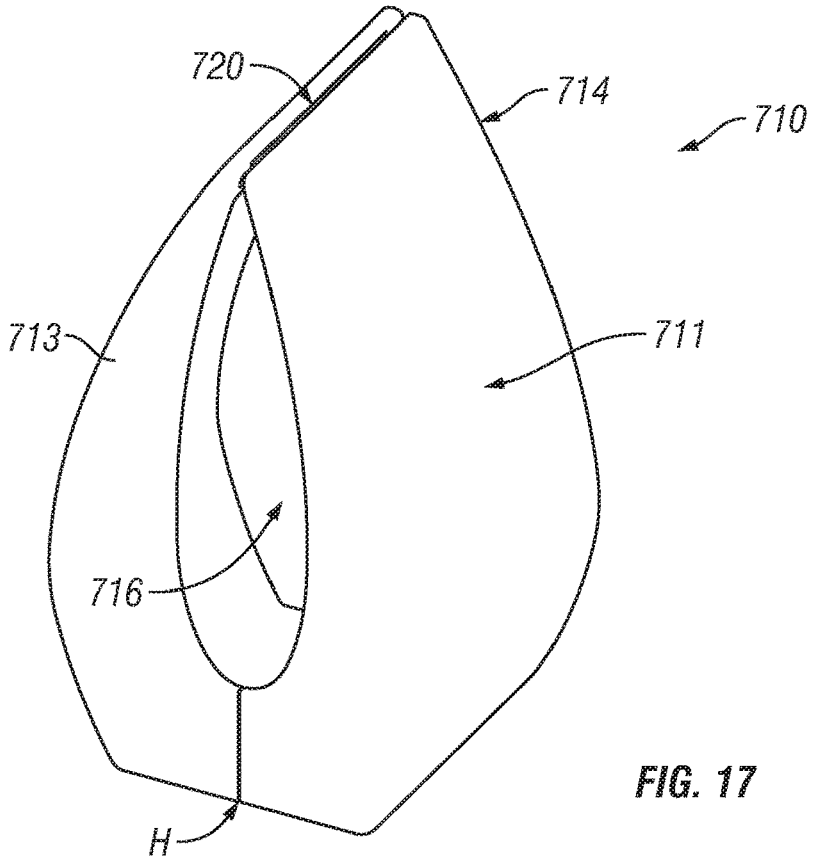
FIG. 17 is a perspective view of a dispenser in accordance with another embodiment of the invention.

In another embodiment, as shown in FIG. 17, dispenser 710 may further be provided in a clam-shell configuration. The dispenser 710 includes a housing 714 defining an inner chamber 716. The inner chamber 716 is open on the sides and allows the consumer to readily view the multi-piece package stored within the inner chamber 716. An alternate configuration may further provide an enclosed claim-shell design. Dispenser 710 further includes a portion 711 and a portion 713 hingedly attached (H) to one another. The combination of portion 711 and portion 713 form slot 720 for receiving and retaining the multi-piece package. Although not shown, a retention member, including at least one retention tab, may be integrated and used in connection with slot 720.

Figure 18:
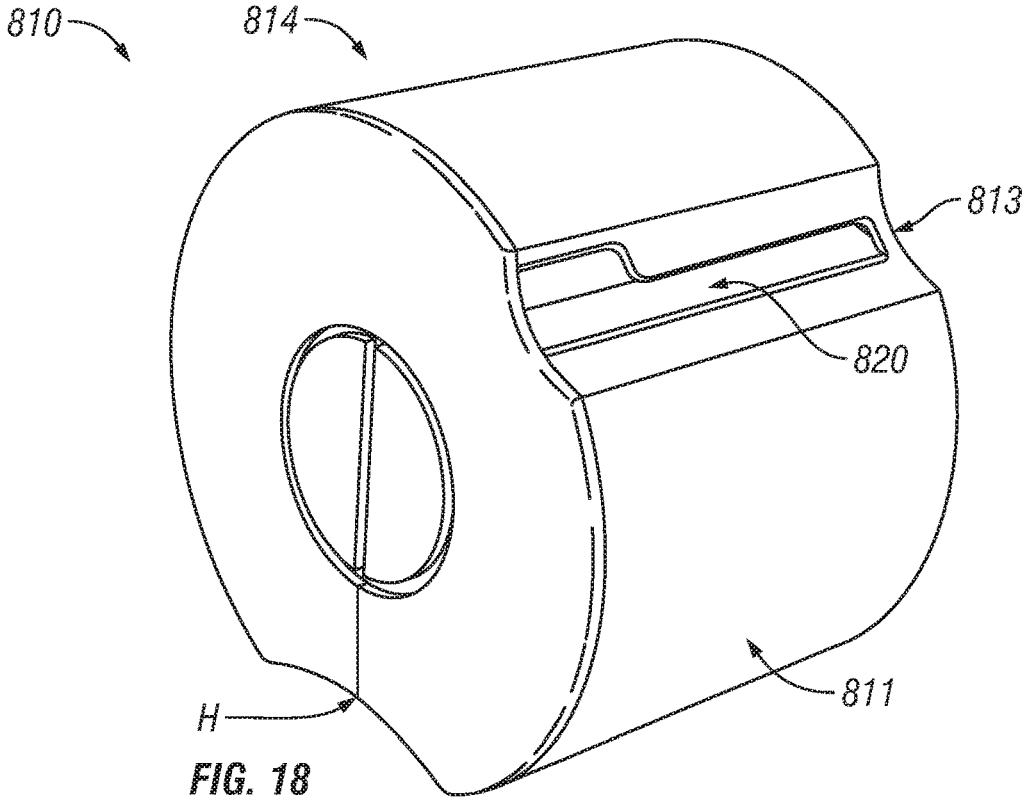
FIG. 18 is a perspective view of a dispenser in accordance with another embodiment of the invention.

Furthermore, in an alternate embodiment, dispenser 810 is provided in a circular or ring shaped configuration. In one embodiment the dispenser 810 may be hollow in the center, therein providing a ring shaped configuration. Alternatively, the dispenser may have full formed side portions, as shown in FIG. 18, therein providing a circular shaped configuration. Moreover, in another embodiment, a circular dispenser may be provided. In accordance with an embodiment of the invention, dispenser 810 includes a housing 814 defining an inner chamber (not shown). The housing 814 further includes a body portion 811 and a side portion 813. The side portion 813 may be hingedly coupled to body portion 811, or alternatively may be a separate portion that engagingly couples to the body portion 811. The body portion 811 further defines a slot 820 for receiving and retaining the multi-piece package. The side portion 813 is provided to enclose housing 814 and secure the multi-piece package within the dispenser 810.

Figure 19:
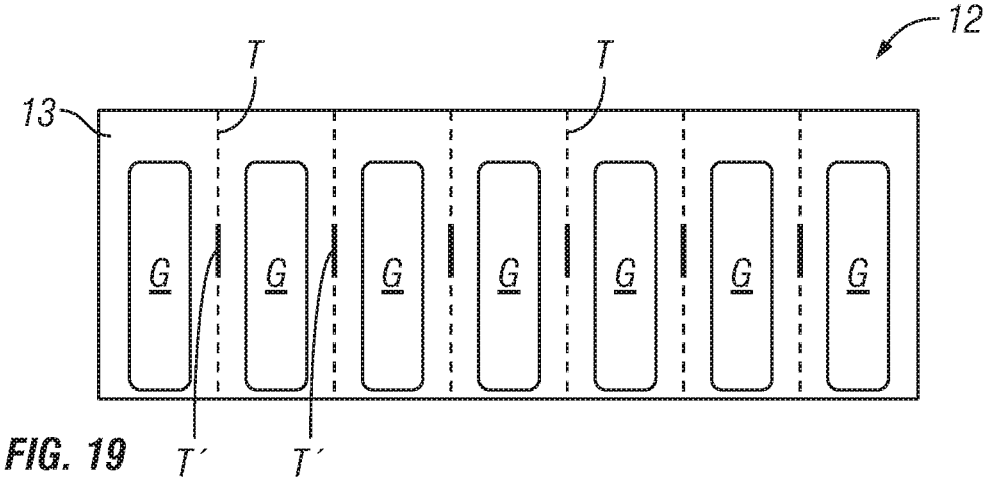
FIG. 19 is a perspective view of a multi-piece package in accordance with embodiment of the invention.
Figure 20:
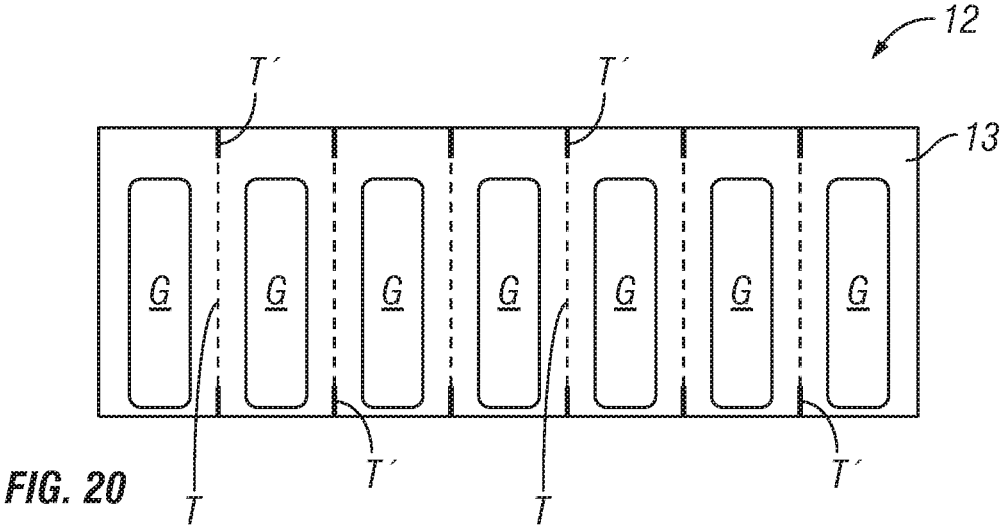
FIG. 20 is a perspective view of a multi-piece package in accordance with another embodiment of the invention.
Figure 22:
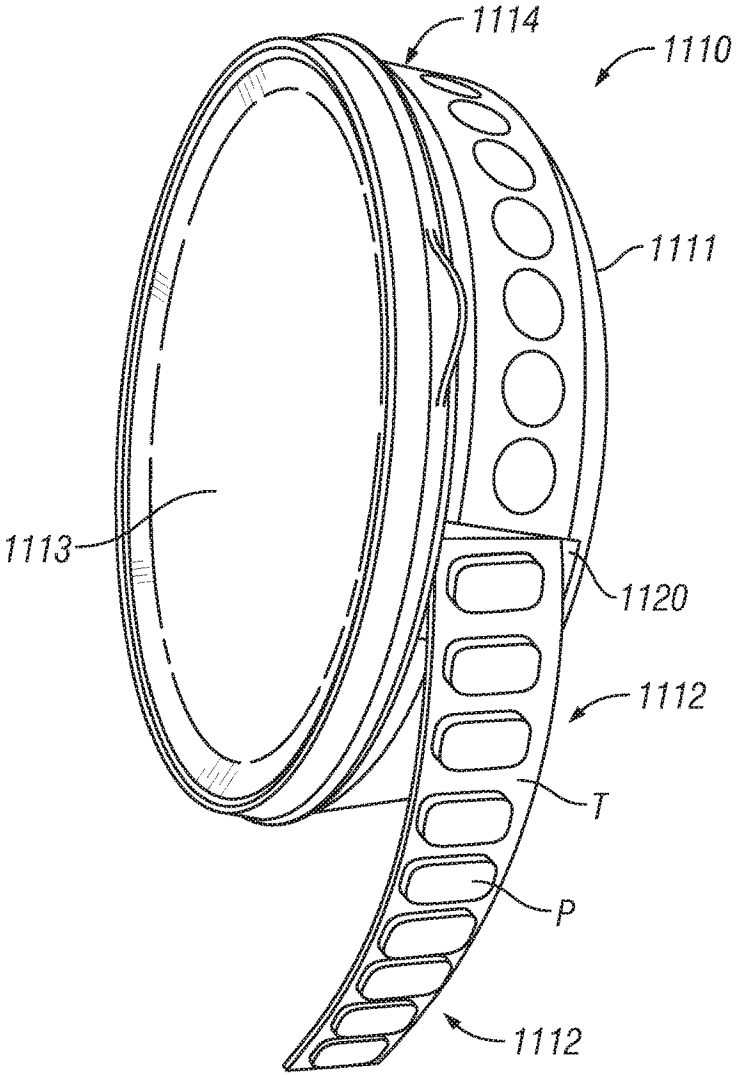
FIG. 22 is a front perspective view of the dispenser as shown in FIG. 21.
Figure 21:
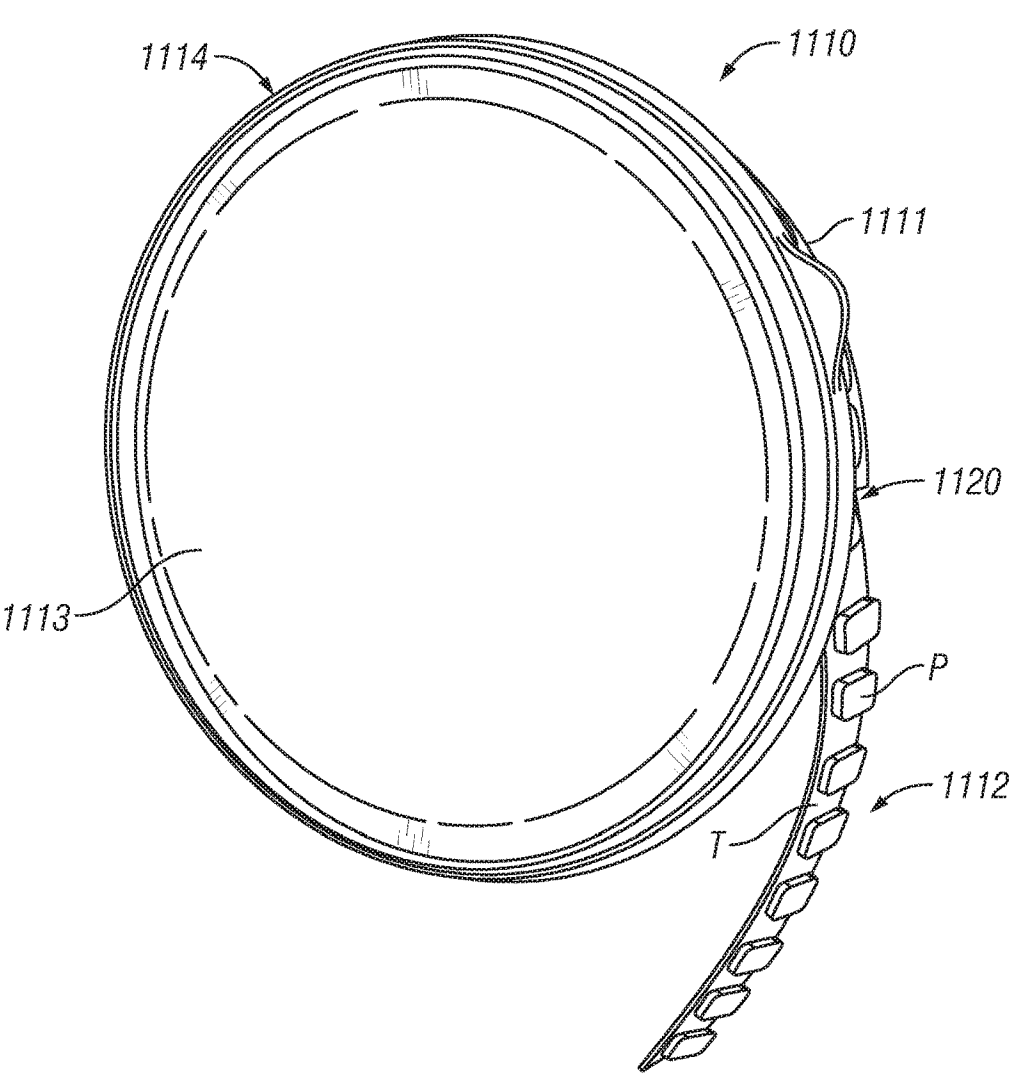
FIG. 21 is a side perspective view of a dispenser in accordance with another embodiment of the invention.

As previously discussed, the present invention is directed to a dispenser for use with a multi-piece package. Moreover, the disclosure relates to the multi-piece package and the method of manufacturing the multi-piece package for dispensing. Overall, the multi-piece package is directed to a strip-like structure containing a plurality of individual pieces of confectionary product, in particular, chewing gum. The individual pieces of gum may be separately sealed but are coupled together to form the multi-piece package, also referred to as a bandoleer. In order to separate the individual pieces from one another, a tear line T may be provided, such as those shown in FIGS. 19 and 20. As can be seen in FIG. 19, the multi-piece package 12 includes individual gum pieces G that enclosed by a material 13, such as for example, a film that is used to seal the gum pieces. Alternative, the gum pieces may be enclosed in individual blister-type packages that are coupled together to form a roll-like bandoleer (as shown, for example, in FIG. 21-22, 25). Each of the individual gum pieces are separated by a tear line T. The tear lines may be perforated along the entire length of the tear line or just a portion thereof. Alternatively, tear notches T may be provided along the tear line, such that a tear member (i.e., tear member 40 shown in FIG. 5) may further assist in separating the individual pieces from one another. Alternatively, the tear notch T may be offset from the tear line T, such that the individual gum pieces may be separated from one another and then a tear notch is provided within the package to open the package. In general, the tear notch T may be provided throughout various locations of the package for opening the package. Alternatively, a consumer may easily tear the individual pieces apart based on either the perforated tear line T, as shown in FIG. 19, or the additional tear notches T' provided on the ends of the individual wrapped pieces, as shown in FIG. 20. Although FIGS. 19 and 20 show the individual gum pieces coupled together on the length of the gum pieces, alternate configurations are considered, such that the tear line is repositioned and the gum pieces are placed end to end within the package.

Alternate embodiments of the dispenser may further include those shown having a blister-type multi-piece package, as shown for example in FIGS. 21-30. As can be seen throughout the Figures, dispenser 1110 may be configured to retain a multi-piece package 1112 designed to enclose individual pieces of pellet-type gum forms within individual blister packages P. The individual gum pieces are providing in package 1112 may be separated by a tear line T. Alternatively, each of the gum pieces could be manually separated by a consumer through mechanically severing (i.e., cutting) the pieces apart. In accordance with an embodiment of the invention, dispenser 1110 includes a housing 1114 having a body portion 1111 and a side portion 1113 (alternately, the side portion 1113 may be considered the top portion depending on the orientation of the dispenser, and the body portion may be considered the bottom portion). The body portion 1111 and side portion 1113 may be coupled together to form an inner chamber 1116, as partially shown for example in FIGS. 23-25. Body portion 1111 and side portion 1113 may be coupled together through any type of coupling mechanism, including for example, but not limited to, a snap-fit configuration, an interlocking mechanism, a hook and loop mechanism or any other type known by one of ordinary skill in the art. Alternatively, side portion 1113 may be hingedly connected to body portion 1111, as previously described in relation to other configurations of dispensers.

Figure 23A:
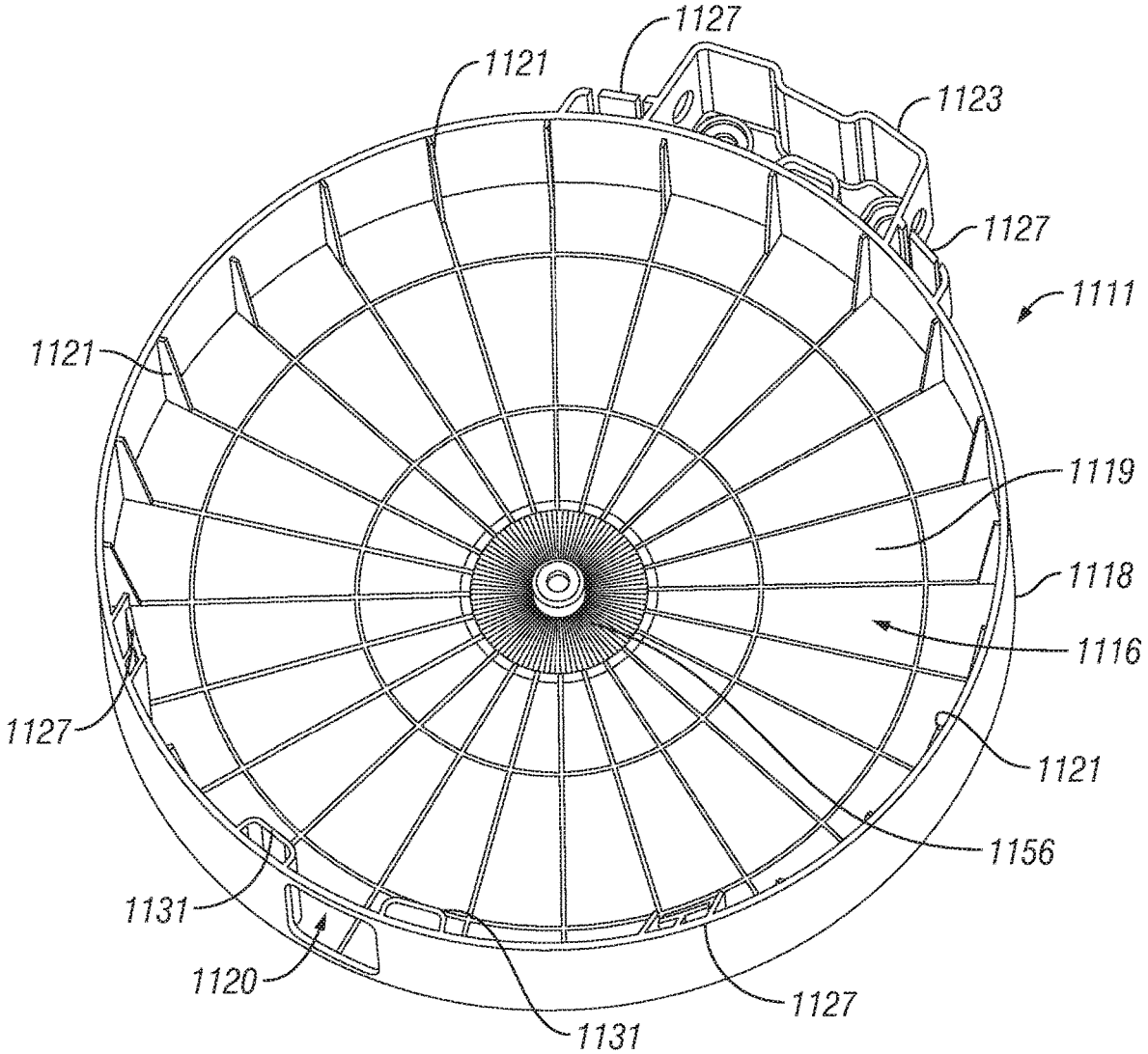
FIG. 23A is perspective view of a portion of the dispenser in accordance with an embodiment of the invention, wherein another portion has been removed to show the interior of the dispenser.
Figure 23B:
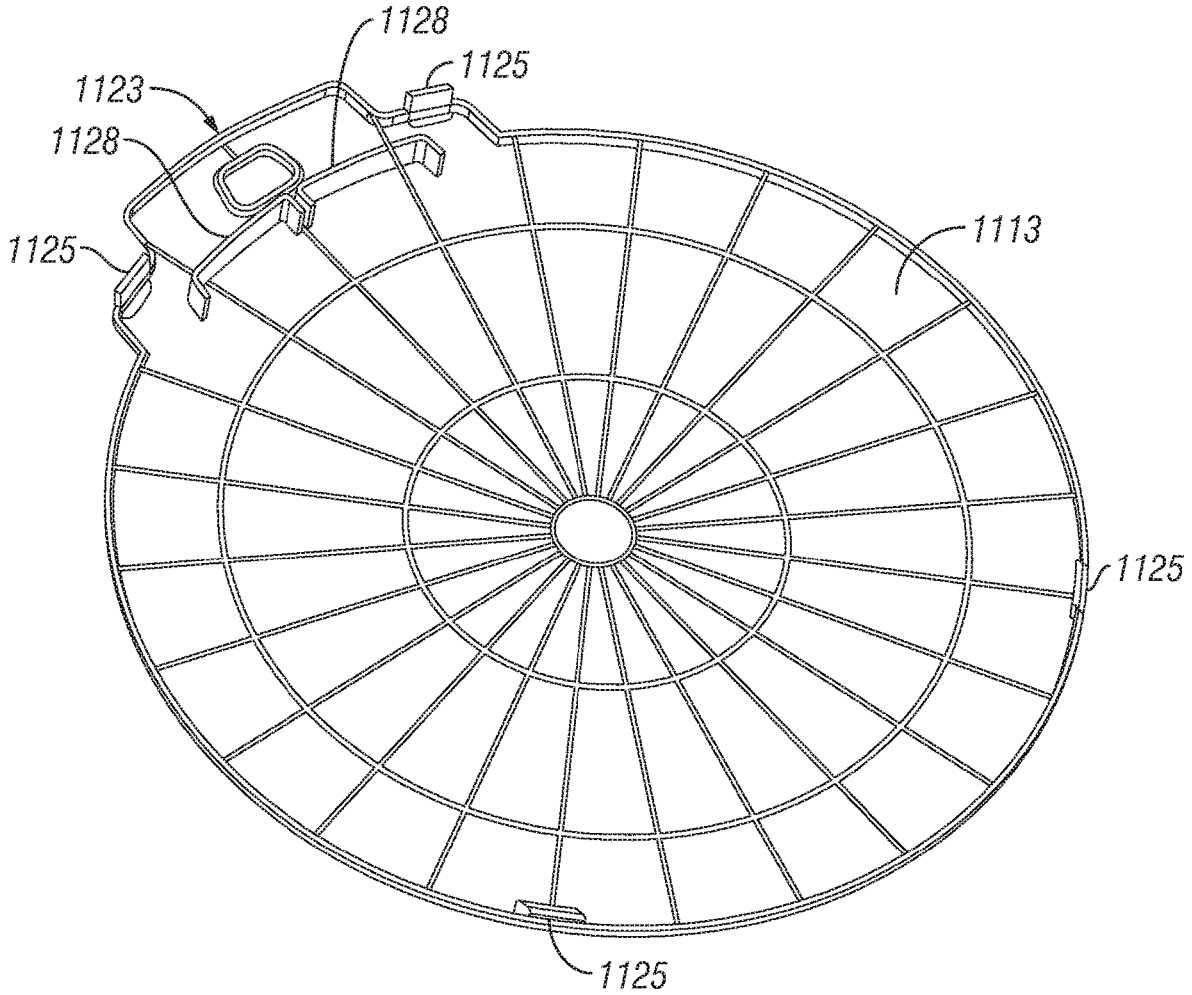
FIG. 23B is a perspective view of another portion of the dispenser that may be coupled with the portion in FIG. 23A to provide the dispenser.

In accordance with an embodiment, as shown more specifically in FIGS. 23A and 23B, body portion 1111 is further defined by an outer wall 1118 and bottom surface 1119 therein providing an inner chamber 1116. Additional support members 1121 may be integrated within the body portion 1111 to further reinforce the structure and increase rigidity. Alternate support members may also be provided depending on the design of the dispenser 1110. The support members may further be configured to reflect the configuration of the package 1112 or help facilitate movement of package 1112 within inner chamber 1116, as more clearly shown in FIG. 25.

Dispenser 1110 may further include a hanging member 1123 to enable the dispenser to be hung in various location or positions or secured in position (either to a wall, counter, or any other location that would be convenient to consumers or retail locations). The hanging member 1123 may have alternate configurations depending on the design of the dispenser. Moreover the dispenser 1110 may be secured in position by either a fastener (such as for example, screws/ nails), a hooks/loop type mechanism or any other type of coupling or securing mechanism that is known by one of ordinary skill in the art.

In accordance with an embodiment of the invention, body portion 1111 and side portion 1113, as shown for example in FIGS. 23A and 23B, may be coupled together to form dispenser 1110. As previously suggested, side portion 1113 and body portion 1111 may be secured either though a snap-fit, locking or any other type of connection means known by one of ordinary skill in the art (such as for example, incorporating connection members 1125 in side portion 1113 for engagement with receiving portions 1127 provided by body portion 1111). As a result, side portion 1113 and body portion 1111 may be separated for refilling of the dispenser and then subsequently reconnected. Moreover, side portion 1113 may further include alignment members 1128 that further help guide or align side portion 1113 with body portion 1111 prior to attachment of the two portions together.

As previously discussed, a slot 1120 may be integrated as part of body portion 1111 allowing package 1112 to extend outside of the housing 1114 resulting in end portion 1122 of package 1112 being readily accessible to either a consumer or vendor. Alternate placements of slot 1120 may be considered within housing 1114 depending on the needs of the consumer and for manufacturing capabilities. Slot 1120 may be configured as threaded (as shown in FIGS. 23-25) but alternatively the slot may be non-threaded in accordance with the previously described embodiments.

Dispenser 1110 may further include a retention member as previously disclosed in relation to alternate embodiments wherein various retention members (although not shown) may be integrated with the slot 1120 to further support and retain package 1112 within the dispenser 1110. As shown in FIGS. 23A, 24-25, the retention member may further include guide members 1131 to further facilitate the movement of package 1112 into slot 1120. Alternate configurations of guide members 1131, although not shown, may further include for example, flexible members that allow for flexing of the member 1131 relative to the package, as well as the incorporation of foam or other related materials that would provide the desired amount of friction and guidance but not inhibit the movement of the package within the inner chamber 1116. Each of these elements could be integrated within either body portion 1111 or side portion 1113 depending on the design and functionality of the dispenser 1110.

Figure 24:
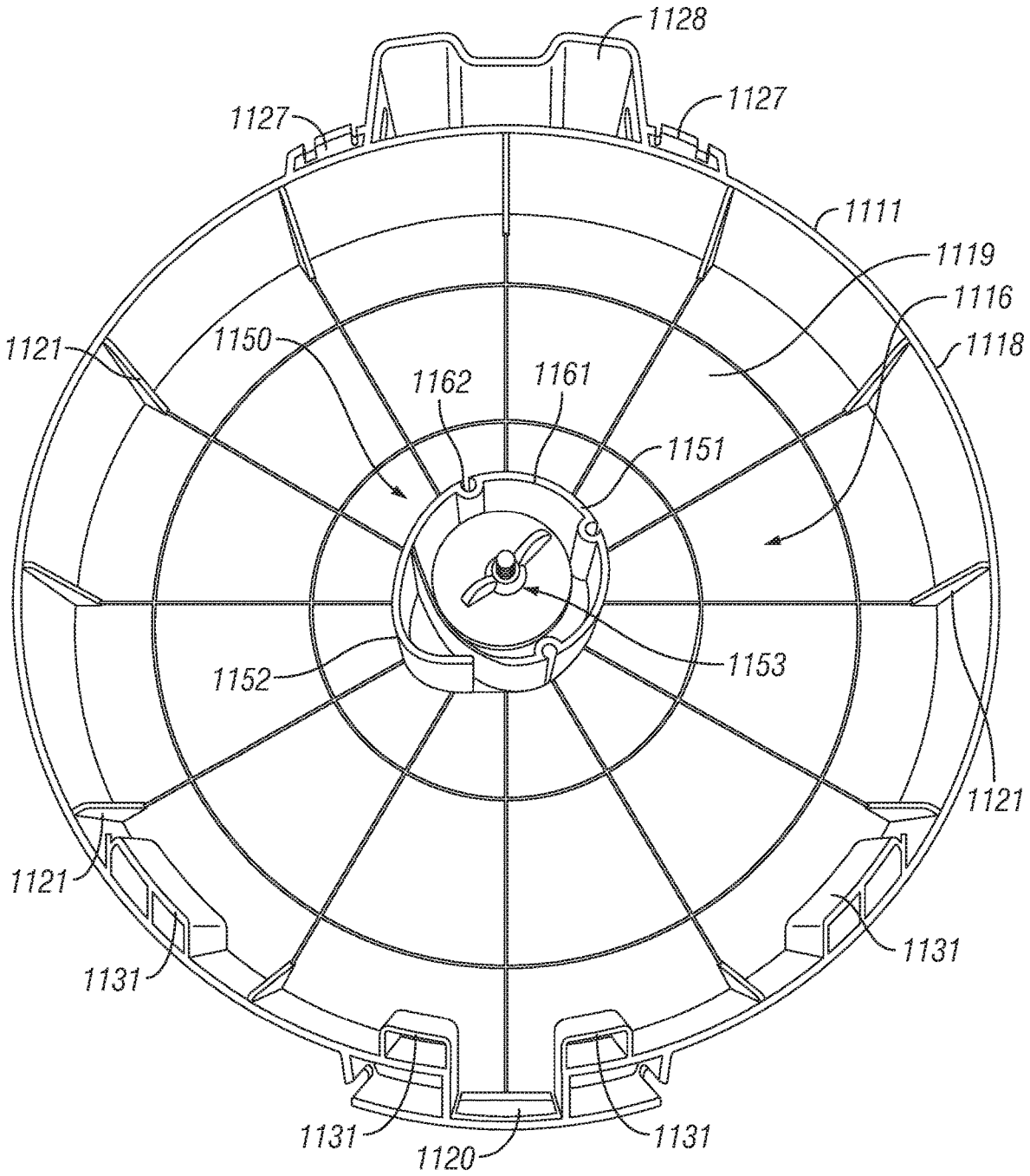
FIG. 24 is perspective view of a portion of the dispenser in accordance with another embodiment of the invention, showing the interior of the dispenser.
Figure 25:
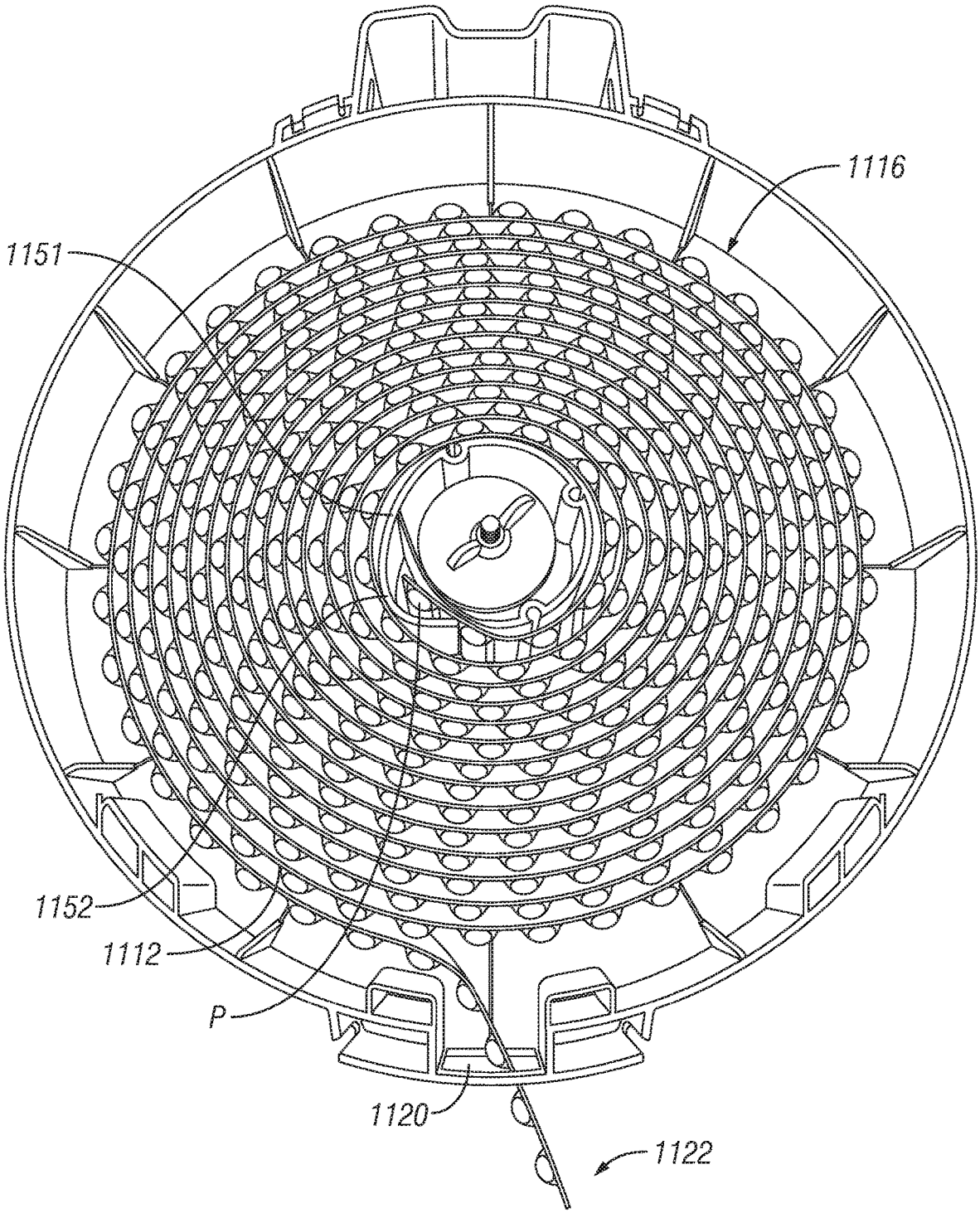
FIG. 25 is a front perspective view of the dispenser as shown in FIG. 24, wherein a multi-piece package, in accordance with an embodiment of the invention, has been inserted into the dispenser.
Figure 26:
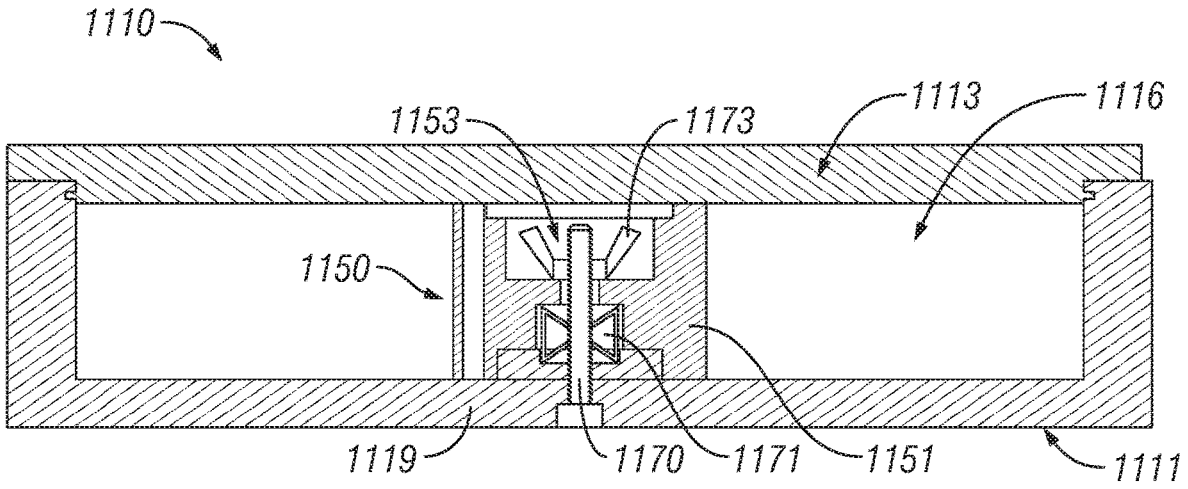
FIG. 26 is a cross-sectional view of an alternate embodiment of a dispenser.
Figure 27:
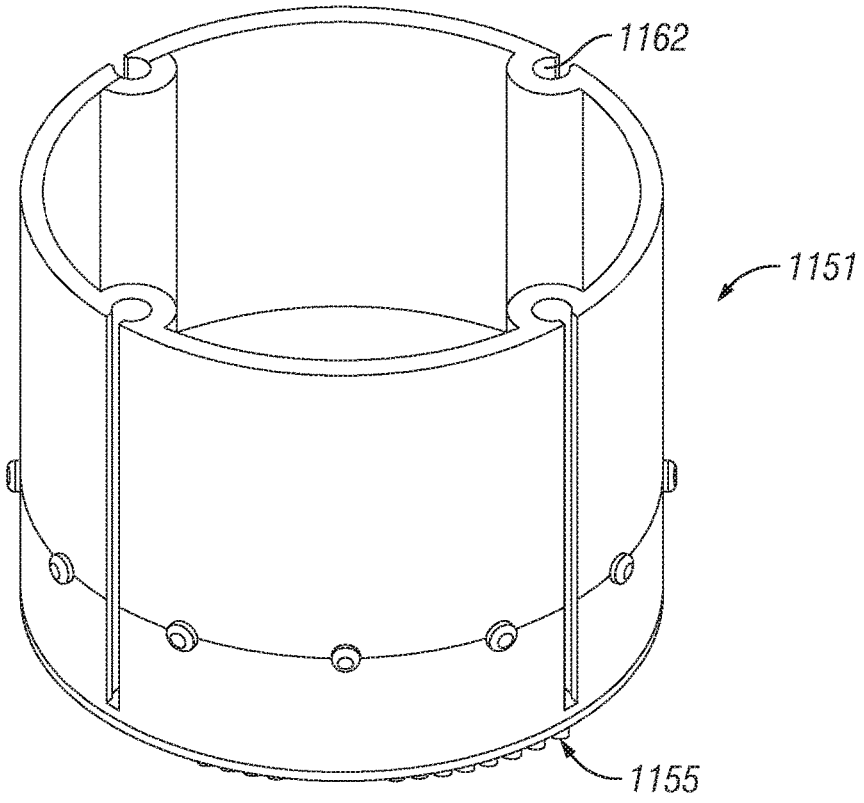
FIG. 27 is a perspective view of a portion of the tension assembly in accordance with an embodiment of the invention.

In a further embodiment, the dispenser 1110 may further include a tension assembly 1150, as can be seen for example in FIGS. 24-26. The tension assembly 1150 may be further provided to ensure that the package 1112, as shown in FIG. 25, is retained within the inner chamber 1116 of dispenser 1110 and does not inadvertently extend beyond the slot 1120 an amount which is desired by the consumer. Although the tension assembly 1150 may be placed in various locations within the inner chamber 1116 or oriented in alternate configurations within dispenser 1114, it is desirable to have the tension assembly 1150 positioned in a relatively central location within inner chamber 1116 to optimize the coiling of the package 1112 as seen in FIG. 25. The tension assembly 1150 may further include an outer portion 1151, a coupling member 1152 and a securing assembly 1153.

As suggested, and in accordance with an embodiment, the tension assembly 1150 may be designed to couple and secure the package 1112 to dispenser 1110 while maintaining the preferable coiling of package 1112 within inner chamber 1116 (as more specifically shown in FIG. 25). As can be seen in FIGS. 25 and 26, the tension assembly includes an outer body 1151 that secures the components of the tension assembly 1150 to the dispenser 1110 while coupling package 1112 to the overall tension assembly 1150. An alternate embodiment of the outer body 1151, as more shown in more detail in FIG. 27, may further include a tongue/groove configuration (i.e., teeth-like members) on the bottom 1155 to interface with a corresponding portion 1156 of the bottom surface 1119 of body portion 1111 (as shown in FIG. 23A). The corresponding teeth and relative interaction between the bottom 1155 of outer body 1151 of tension assembly 1150 and portion 1156 increases the friction between the dispenser and the tension assembly 1150 to further control the movement of the tension assembly 1150 relative to the housing 1114, in particular body portion 1111.

Figure 28B:
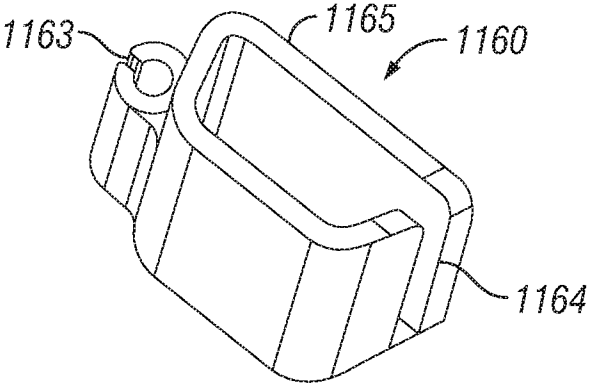
FIGS. 28A and 28B are perspective views of components of the coupling member for use in the dispenser, such as shown in FIG. 25, in accordance with an embodiment of the invention.
Figure 28A:
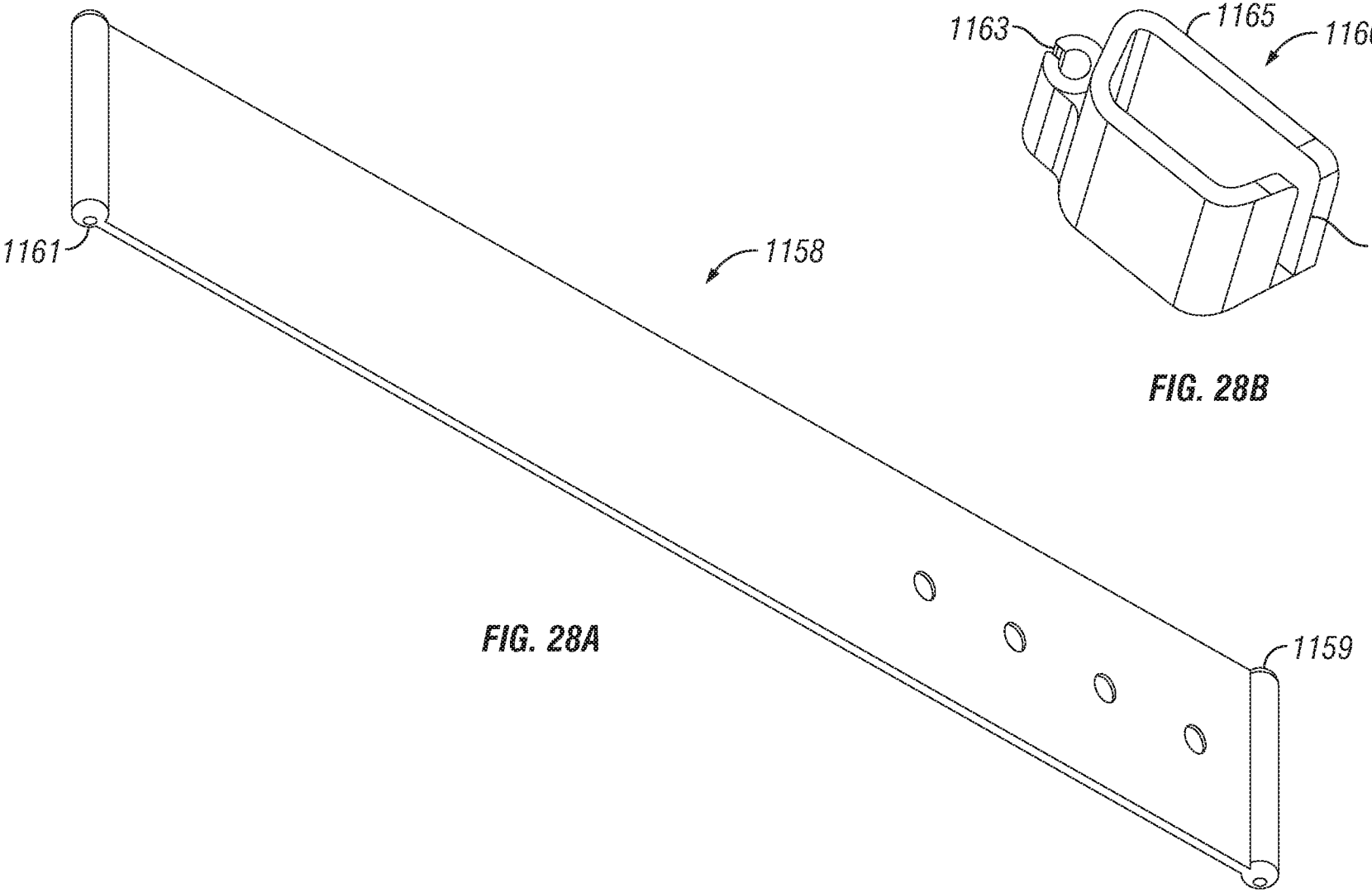

The tension assembly 1150 further includes a coupling member 1152. As shown in FIGS. 24-26. The coupling member 1152 may be integrated as part of the outer body 1151 of tension assembly 1150. The coupling member 1152 is used to interconnect the package 1112 to the tension assembly 1150, therein securing the package coil within the inner chamber 1116 of dispenser 1110. As shown in FIG. 25, in accordance with one embodiment, the last blister P fits within the coupling member and is therefore retained in position due to the design of the coupling member. An alternate configuration may be further considered wherein an extension member 1158 and coupler 1160 (as shown in FIGS. 28A and 28B) may be used for coupling the package 1112 to tension assembly 1150. The extension member 1158, as shown for example in FIG. 28A, provides a connection end 1159 for coupling to a slot 1162 integrated within the outer body 1151 of tension assembly 1150, as shown for example, in FIG. 27. Depending on the design of the outer body 1151, multiple slots 1162 may be formed. The opposite end of extension member 1158 further provides a connection end 1161 that allows for connection to the coupler 1160. Receiving slot 1163 is formed at one end of the coupler 1160, such that connection end 1161 of extension member 1158 is received within slot 1163 therein securing the extension member 1158 to coupler 1160. Opening 1164 of coupler 1160 allows for the end of a package 1112 to be retained by the coupler 1160 such that the last blister of the package 1112 is held within receptacle 1165. Alternate configurations of coupling member 1152 may be used depending on the design of the dispenser 1110. Although plastic or plastic-derived materials are preferred for the design, various materials may be used to form each of these components, including but not limited to plastic, paperboard or other semi-durable type materials that are known by one of ordinary skill in the art.

As previously suggested, a securing assembly 1153 is further provided as part of the tension assembly 1150. As seen in FIGS. 24-26, in particular FIG. 26, the securing assembly 1153 is one example of how to secure the tension assembly 1150 to body portion 1111, but alternate configurations of the securing assembly are contemplated within the scope of the invention. The securing assembly 1153 attaches the body portion 1111 of dispenser 1110 to package 1112. In accordance with one embodiment, as seen in the provided Figures, securing assembly 1153 includes a connection member 1170 (such as for example, a screw) provided through the bottom surface 1119 of body portion 1111 into inner chamber 1116 and through the center of outer portion 1151 of tension assembly 1150. A spring or spring-like member 1171 may be positioned over the connection member 1170 and a securing member 1173 (such as for example, a wing nut) is positioned over the spring to interconnect and retain all of the components of the securing assembly 1153.

Although specific components of the securing assembly have been described and shown, alternate components having similar or equivalent functionality may be used to secure the tension assembly 1150 within dispenser 1110.

Alternate configurations of dispenser 1110 may further provide other functional elements to be incorporated within the outer surface of the housing 1114 of the dispenser 1110. Such elements would include, for example but are not limited to, a clock or any other type of display like window or area that would allow a retailer to use the dispenser for additional purposes.

Figure 29A:
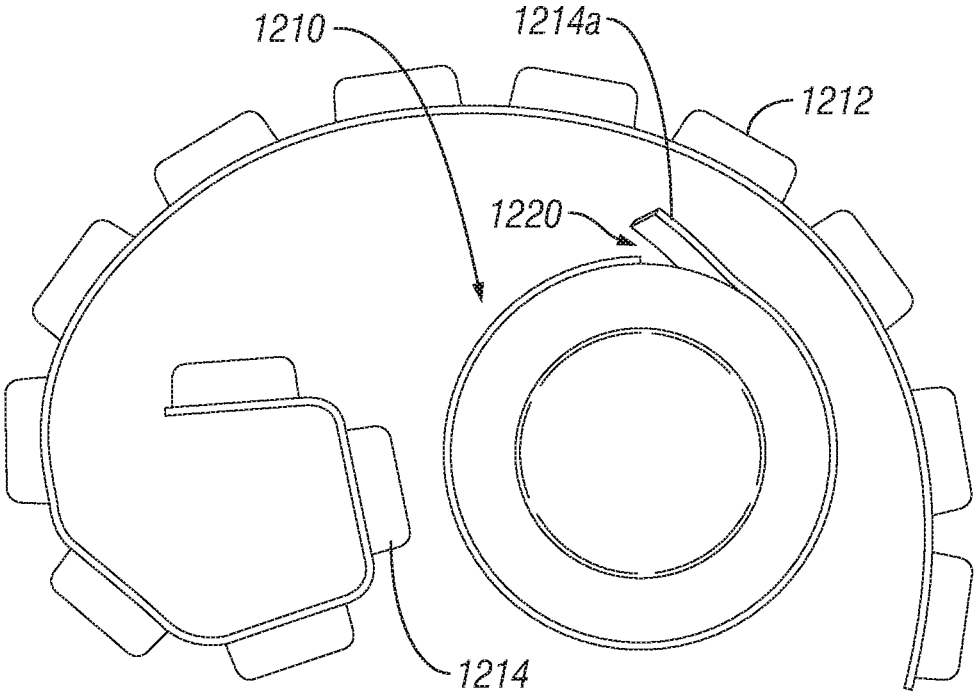
FIGS. 29A and 29B are perspective views of a dispenser and multi-piece package in accordance with an embodiment of the invention.
Figure 29B:
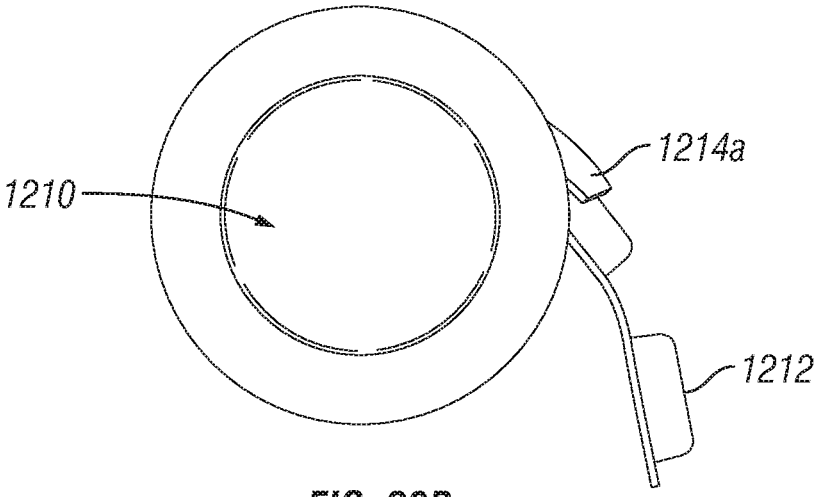

Another embodiment of the present invention further includes an alternate form of a dispenser 1210, as shown in FIGS. 29A and 29B. Accordingly, one embodiment may further provide a hand-held or personal configuration that incorporates a blister package. In accordance with one of the embodiments of the present invention, the handheld dispenser 1210 would include a coil-like configuration of a blister package 1212 and an opening 1220 that would allow for a consumer to access or withdraw a single blister. The opening 1220 could be defined by either a portion 1214*a* of the housing 1214 configured to either slide into the housing 1214 or be hingedly connected to the housing 1214. The hand-held configuration allows for increased sharing among individuals while at the same time maintaining freshness of the product enclosed within the blister package.

Figure 30:
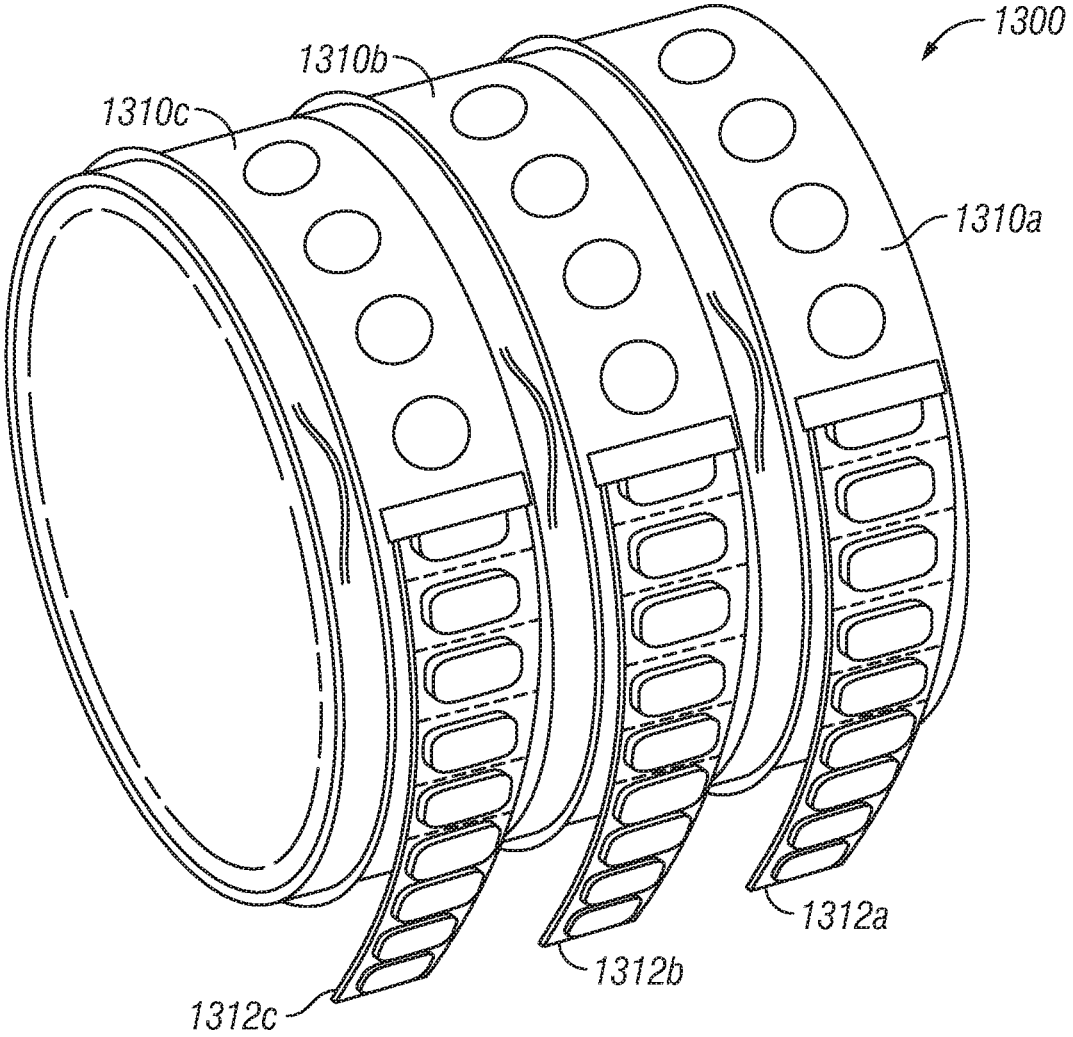
FIG. 30 is a perspective view of a multi-unit dispenser in accordance with another embodiment of the invention.

In another embodiment, the present invention further includes a multi-unit dispenser 1300, as shown in FIG. 30, wherein separate dispensers 1310*a*, 1310*b*, and 1310*c* may be coupled together or integrated with one another to form a dispenser that has multiple different packages 1312*a*, 1312*b*, and 1312*c*. The multi-unit dispenser may be used to dispense different confectionary products either having different forms, flavors, or any other combinations. Accordingly, as an example, one dispenser could include a package for stick gum, while another dispenser includes gum in pellet form, and an additional dispenser could include an alternate confectionary product. Alternatively, as shown, each of the dispensers could include different pellet blister-type packages that have different flavors or products within the packages. The multi-unit dispenser may include at least one housing having individual slots for the separate packages or alternatively multiple housings may be provided that are coupled together, as known by one of ordinary skill in the art. Although FIG. 30 shows three individual dispensers coupled together, such representation is exemplary by nature and alternate numbers of dispensers and packages may be integrated together depending on the desired form of the multi-unit dispenser. Moreover, the multi-unit dispenser may be provided in alternate shapes and sizes depending on the desired configuration of the dispenser.

The present invention further includes a method for manufacturing the multi-piece package of confectionary product. The multi-piece package includes a three-sided sealed configuration. Accordingly, a piece of material is provided having a predefined width and length. The material may include any type of material that creates an adequate barrier for protecting the confection product inside. Moreover, the material must also exhibit attributes, such as for example, being sealable, tearable, printable and cost effective. As a result, the material may include but is not limited to, the use of orientated polypropylene film. The piece of material is divided (although not physically divided) in half by a central line thereby dividing the material into two halves. A plurality of gum pieces are positioned on one half, such that each of the ends of the individual gum pieces are disposed adjacent to the central line of the film. The gum pieces are separated by a predetermined distance along the length of the film. Once the gum pieces are positioned, the other half (that does not have the gum pieces) is folded about the central line such that the folded half is placed on top of the half of the film that includes the individual chewing gum pieces. Subsequently, the material is sealed about the length and width of the material and between each of the individual gum pieces, such that the gum pieces have a three-sided seal. The fourth side is formed by the folding of the material about the central line. As a result a multi-piece package is created including individual pieces of gum having a three sided seal. The multi-piece package may then be used in connection with any of the various embodiments of the dispenser previously disclosed.

While the invention has been described with respect to certain preferred embodiments, as will be appreciated by those skilled in the art, it is to be understood that the invention is capable of numerous changes, modifications and rearrangements, and such changes, modifications and rearrangements are intended to be covered by the following claims. Moreover, the foregoing descriptions of specific embodiments of the present invention have been presented for purposes of illustration and description. They are not intended to be exhaustive or to limit the invention to the precise forms disclosed, and various modifications and variations are possible in light of the above teaching. The embodiments were chosen and described in order to explain the principles of the invention and its practical application, to thereby enable others skilled in the art to utilize the invention and various embodiments with various modifications as are suited to the particular use contemplated. The invention has been described in great detail in the foregoing specification, and it is believed that various alterations and modifications of the invention will become apparent to those skilled in the art from a reading and understanding of the specification. It is intended that all such alterations and modifications are included in the invention, insofar as they come within the scope of the appended claims. It is intended that the scope of the invention be defined by the claims appended hereto and their equivalents.

All directional references (e.g., upper, lower, upward, downward, left, right, leftward, rightward, top, bottom, above, below, vertical, horizontal, clockwise, and counterclockwise) are only used for identification purposes to aid the reader's understanding of the present invention, and do not create limitations, particularly as to the position, orientation, or use of the invention. Joinder references (e.g., attached, coupled, connected, and the like) are to be construed broadly and may include intermediate members between a connection of elements and relative movement between elements. As such, joinder references do not necessarily infer that two elements are directly connected and in fixed relation to each other. It is intended that all matter contained in the above description or shown in the accompanying drawings shall be interpreted as illustrative only and not limiting. Changes in detail or structure may be made without departing from the spirit of the invention as defined in the appended claims.

The invention claimed is:

1. A multi-piece dispenser for confectionery products, the dispenser comprising:

a multi-piece package of confectionery product;

a housing defining an inner chamber for storing the multi-piece package of confectionery product, the housing including a slot for routing a first distal end portion of the multi-piece package therethrough for dispensing the confectionery product; and a tension assembly disposed in the inner chamber of the housing for securing a second distal end portion of the multi-piece package within the inner chamber, and the tension assembly selectively rotatable by dispensing for retaining the first distal end portion of the package at the slot for further dispensing, wherein the tension assembly further includes an outer body, a coupling member and securing assembly for securing the second distal end portion of the multi-piece package within the inner chamber and retaining the first distal end portion of the package within the slot for further dispensing, and wherein a portion of the outer body of the tension assembly engages a corresponding interior surface of the housing to provide additional friction in rotation of the tension assembly within the inner chamber.

2. The dispenser of claim 1, wherein the housing includes a first portion and a second portion that are coupled together.

3. The dispenser of claim 2, wherein the slot is integrally formed within the first portion of the housing.

4. The dispenser of claim 1, further including a hanging member attached to the housing of the dispenser.

5. The dispenser of claim 1, further comprising guide members for guiding the package through the slot.

6. The dispenser of claim 1, wherein the multi-piece package is wrapped around the outer body of the tension assembly.

7. A multi-piece dispenser for confectionery products, the dispenser comprising:

a multi-piece package comprising a plurality of individually-wrapped pieces of confectionery product;

a housing defining an inner chamber for storing the multi-piece package of confectionery product, the housing including a slot for receiving a first end portion of the multi-piece package for dispensing the confectionery product; and a tension assembly disposed in the inner chamber of the housing for securing a second end portion of the multi-piece package within the inner chamber, and the tension assembly selectively rotatable by dispensing for retaining the first end portion of the package at the slot for further dispensing, wherein the tension assembly comprises a coupling member configured to receive a last of the individually-wrapped pieces, located at the second end portion of the multi-piece package, for securing the second end portion within the inner chamber.

8. The dispenser of claim 7, wherein the housing includes a first portion and a second portion that are coupled together.

9. The dispenser of claim 8, wherein the slot is integrally formed within the first portion of the housing.

10. The dispenser of claim 7, wherein the tension assembly further includes an outer body and a securing assembly for securing the second end portion of the multi-piece package within the inner chamber and retaining the first end portion of the package within the slot for further dispensing.

11. The dispenser of claim 10, wherein the multi-piece package is wrapped around the outer body of the tension assembly.

12. The dispenser of claim 7, further including a hanging member attached to the housing of the dispenser.

13. The dispenser of claim 7, further comprising guide members for guiding the package through the slot.

14. A multi-piece dispenser for confectionery products, the dispenser comprising:

a multi-piece package of confectionery product;

a housing defining an inner chamber for storing the multi-piece package of confectionery product, the housing including a slot for routing a first end portion of the multi-piece package therethrough for dispensing the confectionery product; and a tension assembly disposed in the inner chamber of the housing for securing a second end portion of the multi-piece package within the inner chamber, and the tension assembly selectively rotatable for retaining the first end portion of the package within the slot for further dispensing, wherein the tension assembly further includes an outer body, a coupling member and securing assembly for securing the second end portion of the multi-piece package within the inner chamber and retaining the first end portion of the package within the slot for further dispensing, and wherein a portion of the outer body of the tension assembly engages a corresponding interior surface of the housing to provide additional friction in rotation of the tension assembly within the inner chamber.

15. The dispenser of claim 14, wherein the housing includes a first portion and a second portion that are coupled together.

16. The dispenser of claim 15, wherein the slot is integrally formed within the first portion of the housing.

17. The dispenser of claim 14, further including a hanging member attached to the housing of the dispenser.

18. The dispenser of claim 14, further comprising guide members for guiding the package through the slot.

19. The dispenser of claim 14, wherein the multi-piece package is wrapped around the outer body of the tension assembly.

* * * * *